US009045245B2

(12) United States Patent
Giett

(10) Patent No.: US 9,045,245 B2
(45) Date of Patent: Jun. 2, 2015

(54) KNOTTER ASSEMBLY

(75) Inventor: J. Scott Giett, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 237 days.

(21) Appl. No.: 13/220,798

(22) Filed: Aug. 30, 2011

(65) Prior Publication Data

US 2012/0012013 A1 Jan. 19, 2012

Related U.S. Application Data

(63) Continuation-in-part of application No. 12/717,616, filed on Mar. 4, 2010, now Pat. No. 8,397,632.

(51) Int. Cl.

| | |
|---|---|
| ***B65B 13/28*** | (2006.01) |
| ***B65B 63/02*** | (2006.01) |
| ***B65B 13/06*** | (2006.01) |
| ***B65B 59/04*** | (2006.01) |
| ***B65B 65/02*** | (2006.01) |

(52) U.S. Cl.

CPC ..... *B65B 63/02* (2013.01); *B65B 13/06* (2013.01); *B65B 13/28* (2013.01); *B65B 59/04* (2013.01); *B65B 65/02* (2013.01)

(58) Field of Classification Search

CPC ..... B65B 13/28; B65B 59/04; B65B 63/02; B65B 65/02; B65B 13/06

USPC ..... 100/19 R, 20, 21, 22, 23, 29, 30, 31, 100/33 R; 289/2, 6, 13, 14; 140/93.6, 101, 140/105, 111, 115, 118, 119; 56/341, 344

See application file for complete search history.

(56) References Cited

U.S. PATENT DOCUMENTS

| | | | |
|---|---|---|---|
| 25,783 | A | 10/1859 | White |
| 1,868,141 | A | 7/1932 | Harvey |
| 2,756,783 | A | 7/1956 | Osuch |
| 2,853,885 | A | 9/1958 | Seltzer |
| 2,859,687 | A | 11/1958 | Hill |
| 2,922,359 | A | 1/1960 | Brouse et al. |
| 2,963,958 | A | 12/1960 | Nelson et al. |
| 3,037,534 | A | 6/1962 | Brouse |
| 3,037,535 | A | 6/1962 | Linehan et al. |
| 3,086,450 | A | 4/1963 | Tarbox |
| 3,099,204 | A | 7/1963 | Stromberg |

(Continued)

FOREIGN PATENT DOCUMENTS

| | | | |
|---|---|---|---|
| CN | 2451488 | Y | 10/2001 |
| GB | 325783 | A | 5/1930 |

(Continued)

OTHER PUBLICATIONS

Final Office Action, U.S. Appl. No. 12/717,616, mailed Dec. 28, 2011, 22 pp.

(Continued)

*Primary Examiner* — Jimmy T Nguyen

(74) *Attorney, Agent, or Firm* — Shook, Hardy & Bacon L.L.P.

(57) ABSTRACT

A knotter assembly for use in a wire-tieing system includes various elements. The knotter assembly includes a slidably removable twist module assembly, a removable segment gear assembly, and a removable torque tube assembly having two operating arms that carry operating components for actuating various elements of the knotter assembly.

20 Claims, 26 Drawing Sheets

(56) References Cited

U.S. PATENT DOCUMENTS

| | | | | |
|---|---|---|---|---|
| 3,232,216 | A | 2/1966 | Enstad et al. | |
| 3,251,296 | A | 5/1966 | Smith | |
| 3,295,436 | A | 1/1967 | Dalton et al. | |
| 3,327,618 | A | 6/1967 | Cook | |
| 3,338,273 | A * | 8/1967 | Kalning | 140/101 |
| 3,447,448 | A | 6/1969 | Pasic | |
| 3,880,204 | A | 4/1975 | Sarff et al. | |
| 3,888,134 | A * | 6/1975 | Miranda | 74/405 |
| 3,889,584 | A | 6/1975 | Wiklund et al. | |
| 4,114,527 | A | 9/1978 | O'Neill | |
| 4,164,176 | A | 8/1979 | Brouse et al. | |
| 4,177,842 | A | 12/1979 | Dilley | |
| 4,252,157 | A | 2/1981 | Ohnishi | |
| 4,302,991 | A | 12/1981 | Brouse et al. | |
| 4,403,542 | A | 9/1983 | Lewis | |
| 4,566,378 | A | 1/1986 | Fleissner | |
| 4,577,554 | A | 3/1986 | Brouse | |
| 4,587,791 | A | 5/1986 | Brouse et al. | |
| 4,611,534 | A | 9/1986 | Kudlicka | |
| 4,655,264 | A | 4/1987 | Dilley | |
| 4,730,434 | A | 3/1988 | Knudsen | |
| 4,739,700 | A | 4/1988 | Brouse et al. | |
| 4,817,519 | A | 4/1989 | Brouse et al. | |
| 4,827,991 | A | 5/1989 | Jacobsen et al. | |
| 5,433,255 | A | 7/1995 | Wiedel | |
| 5,467,804 | A | 11/1995 | Kupferschmidt | |
| 5,494,081 | A | 2/1996 | Wiedel | |
| 5,577,760 | A * | 11/1996 | Pressler | 280/124.167 |
| 5,704,283 | A | 1/1998 | Wiedel | |
| 5,870,950 | A | 2/1999 | Wiedel | |
| 5,921,289 | A | 7/1999 | Johnson | |
| 6,009,646 | A | 1/2000 | Johnson | |
| 6,032,575 | A | 3/2000 | Johnson | |
| 6,283,017 | B1 | 9/2001 | Johnson | |
| 6,363,843 | B1 | 4/2002 | Daniel et al. | |
| 6,571,691 | B1 | 6/2003 | Jones | |
| 6,640,700 | B2 | 11/2003 | Helland et al. | |
| 6,745,677 | B2 | 6/2004 | Pearson et al. | |
| 6,755,123 | B2 | 6/2004 | Flaum et al. | |
| 6,857,252 | B2 | 2/2005 | Haberstroh | |
| 6,920,741 | B2 | 7/2005 | Devine | |
| 6,923,113 | B2 | 8/2005 | Bobren | |
| 6,957,835 | B2 | 10/2005 | Rotole | |
| 6,962,109 | B2 | 11/2005 | Bobren et al. | |
| 6,968,779 | B2 | 11/2005 | Doyle et al. | |
| 7,124,679 | B2 | 10/2006 | Daniel et al. | |
| 7,373,877 | B2 | 5/2008 | Wiedel | |
| 7,380,574 | B2 | 6/2008 | Wiedel | |
| 7,412,992 | B2 * | 8/2008 | Wiedel | 140/101 |
| 2009/0250930 | A1 | 10/2009 | Eylenbosch et al. | |

FOREIGN PATENT DOCUMENTS

| | | | |
|---|---|---|---|
| GB | 417803 | A | 10/1934 |
| GB | 420098 | A | 11/1934 |
| GB | 474813 | A | 11/1937 |
| GB | 704931 | A | 3/1954 |
| GB | 984251 | A | 2/1965 |

OTHER PUBLICATIONS

Non-Final Office Action, U.S. Appl. No. 12/717,616, Mail Date: Jun. 12, 2012, 9 pp.

PCT International Search Report, PCT/US2012/052869, mailed Nov. 20, 2012, 17 pp.

Notice of Allowance, U.S. Appl. No. 12/717,616, mailed Nov. 23, 2012, 23 pp.

PCT International Publication No. WO 2011/109506 A1, International Publication Date: Sep. 9, 2011, Inventor: Craig V. Millet, et al. PCT International Search Report, PCT/US2011/026856.

Brian Taylor, Fit to be tied: the right wire-tying system conserves costs while keeping bales in ship-shape-Baler Focus, Recycling Today, Feb. 2003. (5 pages).

"Bundling Demand Met by ISB," Converter The International Technical Publication for the Paper, Board, Film and Foil Converter, Jul. 2003, vol. 40, Issue 7, p. 20. (2 pages).

Cranston Machinery Co., Inc., Oak Grove, Oregon, 1000 Series Wire Strapper.

Non-Final Office Action, U.S. Appl. No. 12/717,616, Mail Date: Aug. 2, 2011.

Chinese Office Action dated Feb. 28, 2015 in Application No. 201280052589.9, 16 pages.

European Search Report dated Apr. 3, 2015 in Application No. 12827753.0, 5 pages.

* cited by examiner

KNOTTER ASSEMBLY

CROSS-REFERENCE TO RELATED APPLICATIONS

This application is a continuation-in-part of and claims priority from nonprovisional application Ser. No. 12/717,616, filed Mar. 4, 2010, now U.S. Pat. No. 8,397,632, and entitled "Knotter Assembly." application Ser. No. 12/717,616 is incorporated herein in its entirety.

BACKGROUND

Various types of bulk materials are shipped, stored, and otherwise processed and distributed in the form of bales. For example, recyclable materials, such as paper, plastic and metal are formed into bales for easier handling. Bulk material such as cotton might also be processed into compressed bales. Formed bales are easier and more efficient to handle than loose bulk material. Furthermore, bales are more organized and take up less storage or shipping space than loose material.

In a baling process, the loose material is collected and formed into a bale. After the bales of material are formed into the proper shape, they are usually wrapped or otherwise fitted with a structure which will keep them in the desired bale shape. For example, it is generally known to wrap bales of compressible material with wire or some other elongated binding device to keep the bales in their form for shipping and storage. Wire is preferable because of its strength, low cost, and the ease with which it is handled.

One method of forming a bale directs the compressible material into an automatic baler where it is pressed into a bale by a ram and then moved by the ram through the baler. At a certain position along the baling path, the bale is tied or bound together with wire. More specifically, a tieing system is used with the baler and guides a continuous wire strand around the bale through a wire-guide track to surround the bale as it progresses through the baler. The wire is overlapped when it completely surrounds the bale. The tieing system engages the bale and the overlapped wire and ties the wire around the bale.

Pneumatic, hydraulic, or electric wire-tieing machines having means for gripping and twisting two wires, or opposite ends of the same wire, together are well-known. In these and similar systems, a knotter assembly associated with the tieing system engages the overlapped wire and twists together the overlapped ends of the wire strands to secure the wire in place around the bale. The knotter assembly utilizes a slotted wire-twister pinion having a central pinion gear. Separate bearing elements and bushings are mounted for supporting and protecting the gear, and wire guides, wire-guide blocks, fingers, cutters, and other parts must be separately installed for knotting and cutting the wire. Such parts are subject to wear and breakage and must be replaced from time to time.

In addition, different sizes of these parts may be required for processing wires of different gauge, so that, again, the parts must be changed. Such changes of parts may require considerable down time whereby the efficiency in the overall wire-tieing operation is reduced. As a result, baling facilities often use the heaviest wire that will be needed for a given manufacturing period on all applications, regardless of whether the application could be done with a lighter wire. Thus, the lack of the ability, in conventional knotter assemblies, to quickly change out the parts discussed above leads to inefficiencies, high wire costs, and the like.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

A wire tieing system in accordance with the principles of the present invention is utilized to wrap and tie a bale of material with wire. The system comprises a wire guide for guiding the wire around a bale of material and a knotter assembly configured for receiving portions of wire in the guide and securing the portions together to tie the wire, and therefore, tie a bale of material. Generally the knotter assembly is mounted at the top or proximate the wire guide. The apparatus is used with a baling device of suitable construction.

Embodiments of the present invention relate to a knotter assembly for use in a wire-tieing system on a baler. In embodiments, the assembly includes a base plate; a pair of substantially parallel opposed side walls, wherein each of the side walls has an aperture formed therein; and a set of flanges for selectively securing a pivot shaft, having a first end and a second end, disposed between the side walls that rotatably supports a torque tube assembly disposed between the flanges when installed, wherein the torque tube assembly includes a torque tube and a pair of operator members fixably attached to the torque tube, wherein each of the flanges includes a cylindrical protrusion that extends from a ring portion of the flange, wherein each of the flanges are slidably coupled with the pivot shaft by aligning an outer portion of the cylindrical protrusion with a corresponding aperture and sliding the flanges through the corresponding aperture onto the pivot shaft such that the cylindrical protrusions surround the first end and the second end of the pivot shaft.

Various embodiments of the inventions include a wire-tieing machine for twisting or tieing together end portions of wires. In embodiments, the machine includes a frame assembly, wherein the frame assembly includes a base plate and a pair of parallel opposed side walls; a twist module assembly, wherein the twist module assembly includes a main block that houses a twister pinion having a pinion gear with a first plurality of teeth; and a segment gear assembly, wherein the segment gear assembly includes a segment gear having a second plurality of teeth that engage the first plurality of teeth of the pinion gear when rotated to generate a four-twist knot, wherein the segment gear includes a straight drive slot. In embodiments, a roller cam engages the straight drive slot in the segment gear such that actuation of operator members causes the roller cam to drive the segment gear, which, in turn, drives the twister pinion.

Embodiments of the invention include a wire-tieing machine for twisting or tieing together end portions of wires that includes a frame assembly, wherein the frame assembly includes a base plate and a pair of parallel opposed side walls; a twist module assembly, wherein the twist module assembly includes a main block that houses a twister pinion having a pinion gear with a first plurality of teeth; and a segment gear assembly, wherein the segment gear assembly includes a segment gear having a second plurality of teeth that engage the first plurality of teeth of the pinion gear when rotated to generate a four-twist knot, wherein the segment gear includes a straight drive slot.

These and other aspects of the invention will become apparent to one of ordinary skill in the art upon a reading of the following description, drawings, and the claims.

BRIEF DESCRIPTION OF THE DRAWINGS

The present invention is described in detail below with reference to the attached drawing figures, wherein.

DETAILED DESCRIPTION

Figure 1:
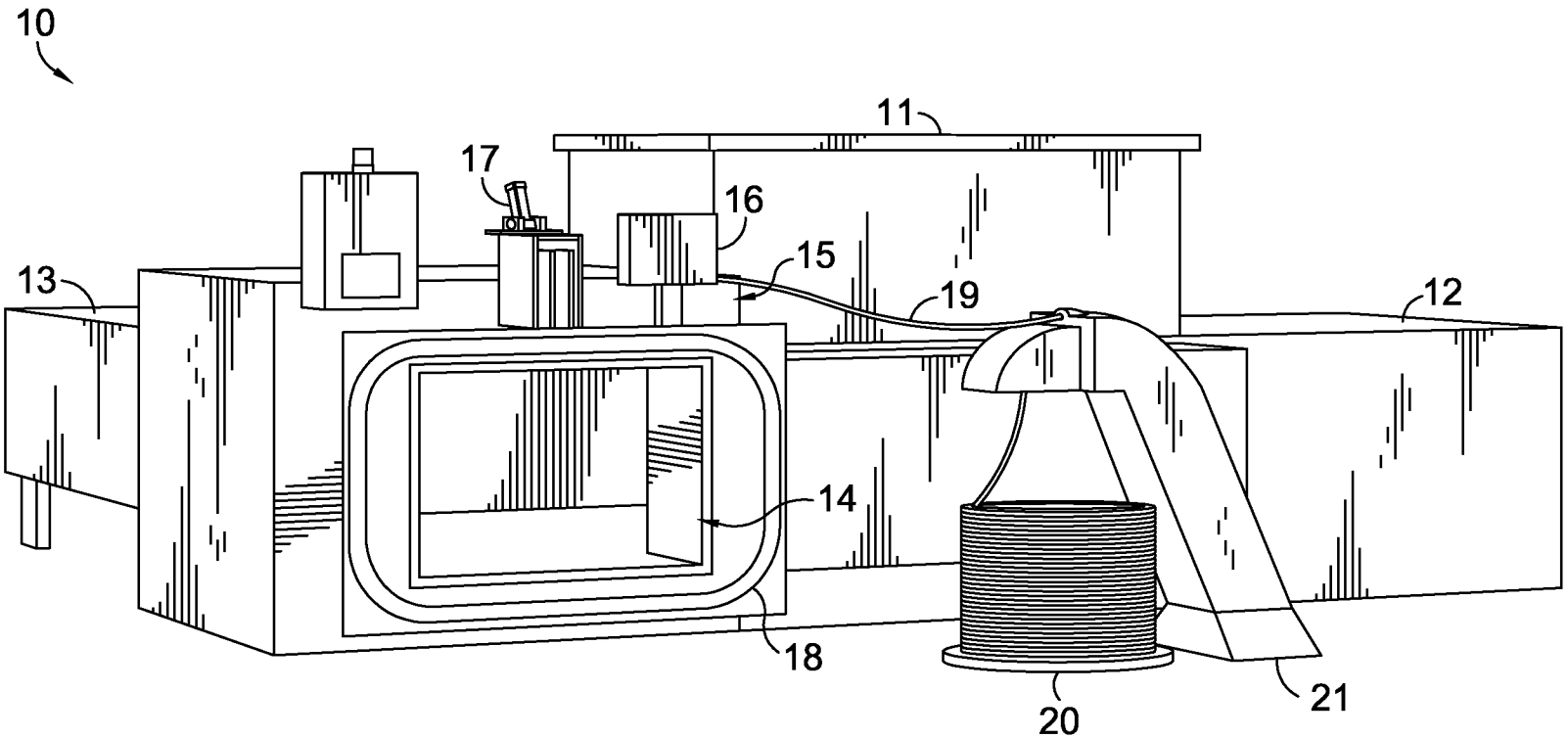
FIG. 1 depicts a perspective view of a two-ram baler with a wire-tieing device in accordance with embodiments of the present invention.

Turning now to the drawings, which are not represented in scale, but rather to clearly show the various embodiments and constructions, FIG. 1 depicts a front perspective view of an exemplary baling machine 10 in accordance with embodiments of the inventions. The baling machine 10 can be a horizontal baler, a vertical baler, a two-ram baler, or any other type of machine used for baling materials. The illustrated baling machine 10 is a two-ram horizontal baler and includes an inlet hopper 11, a first ram 12 for compressing the material, a second ram 13 for ejecting the baled material, a bale outlet 14 and a wire-tieing system 15 disposed around the bale outlet 14. The baling machine 10 can include any number of other assemblies, as well.

As shown in FIG. 1, the wire-tieing system 15 includes a pinch-roll mechanism 16, a knotter assembly 17, and a spring-loaded, separable wire guide track 18 disposed around the bale outlet 14. The pinch-roll mechanism 16 pulls wire 19 from a spool 20. In embodiments, a feed and tensioning structure 21 can be used to ensure that the wire is properly fed around the track 18 under sufficient tension to be engaged by the knotter assembly 17.

In operation, the wire 19 is directed around the track 18, which includes a groove (not shown) such that the leading end of the wire 19 overtakes the trailing end. A bale of material (not shown) is directed into the bale outlet 14, which is encircled by the track 18. The wire 19 encircling the bale is engaged by the knotter assembly 17, which cuts the trailing wire and engages the ends of wires to twist the ends of the wires together for tieing, and for securing the wire around the bale. The system 15 will generally be utilized with a baling structure or baler, and the bale of material is pushed through the outlet 14 by the baler. Exemplary wire-tieing systems of the type depicted in FIG. 1 include the Model 330 and Model 340 Tieing Systems available from L & P Wire-Tie Systems, a Division of Leggett Platt, Incorporated of Carthage, Mo.

Figure 2B:
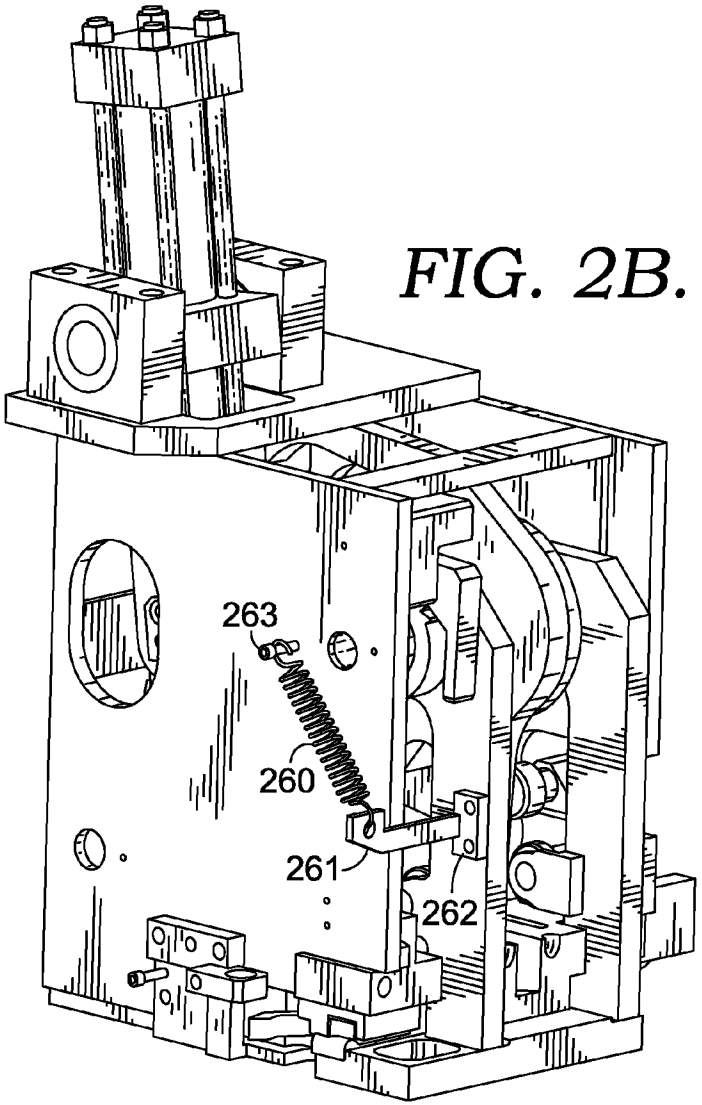
FIGS. 2A and 2B depict perspective views of a knotter assembly in accordance with embodiments of the present invention.
Figure 2A:
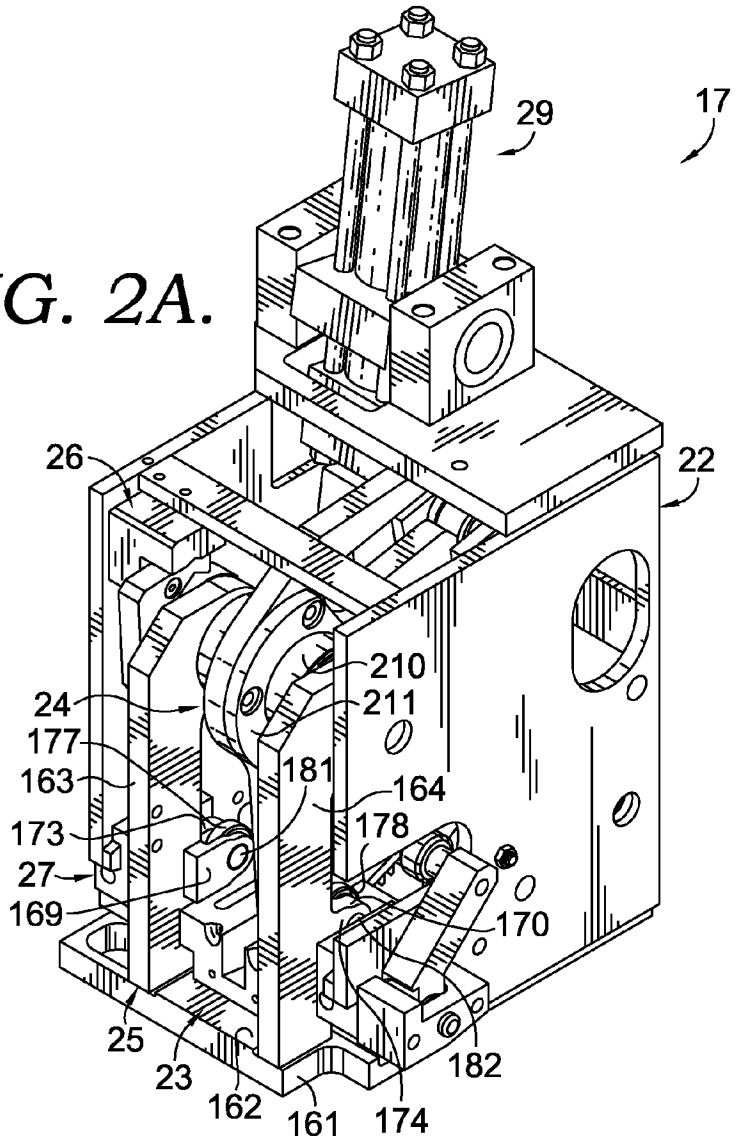
Figure 3:
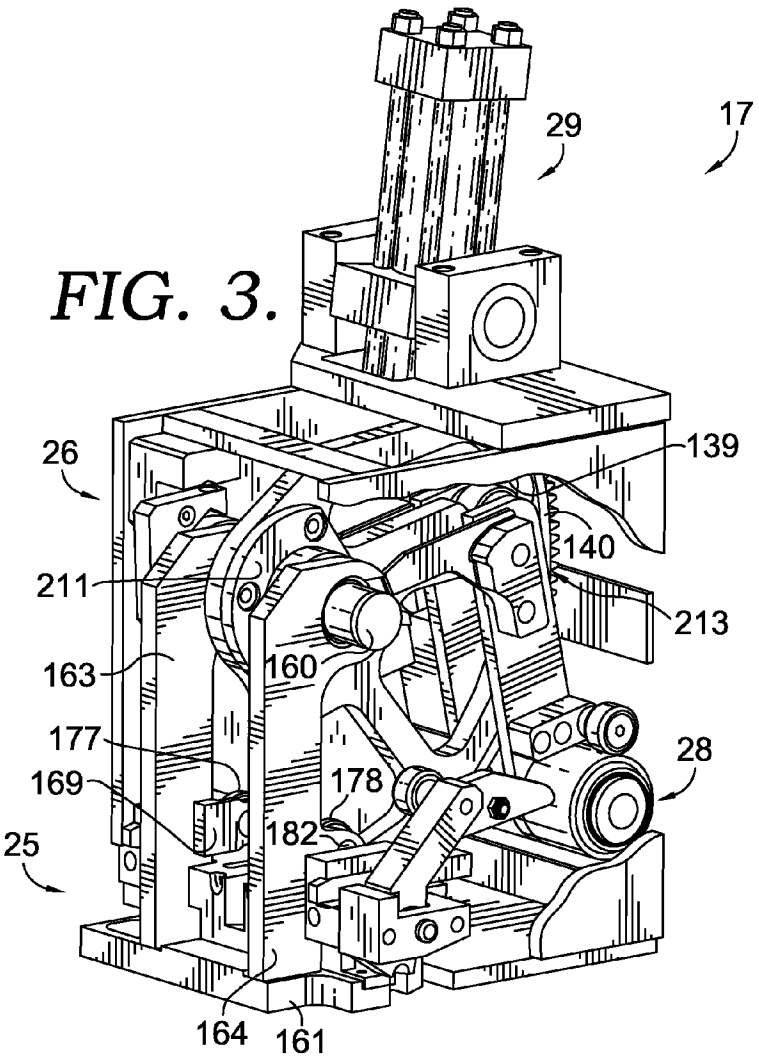
FIG. 3 depicts another perspective view of a knotter assembly, with a side wall cut away, in accordance with embodiments of the present invention.

Turning now to FIGS. 2A, 2B, and 3, perspective views of the knotter assembly 17 are depicted in accordance with embodiments of the inventions. The knotter assembly 17 broadly includes a frame assembly 22, a twist module assembly 23, a segment gear assembly 24, a knotter arm assembly 25, a ratchet assembly 26, a gripper assembly 27, a torque tube assembly 28, and a cylinder assembly 29. In embodiments, the knotter assembly 17 can include other assemblies and parts not illustrated herein.

Figure 4:
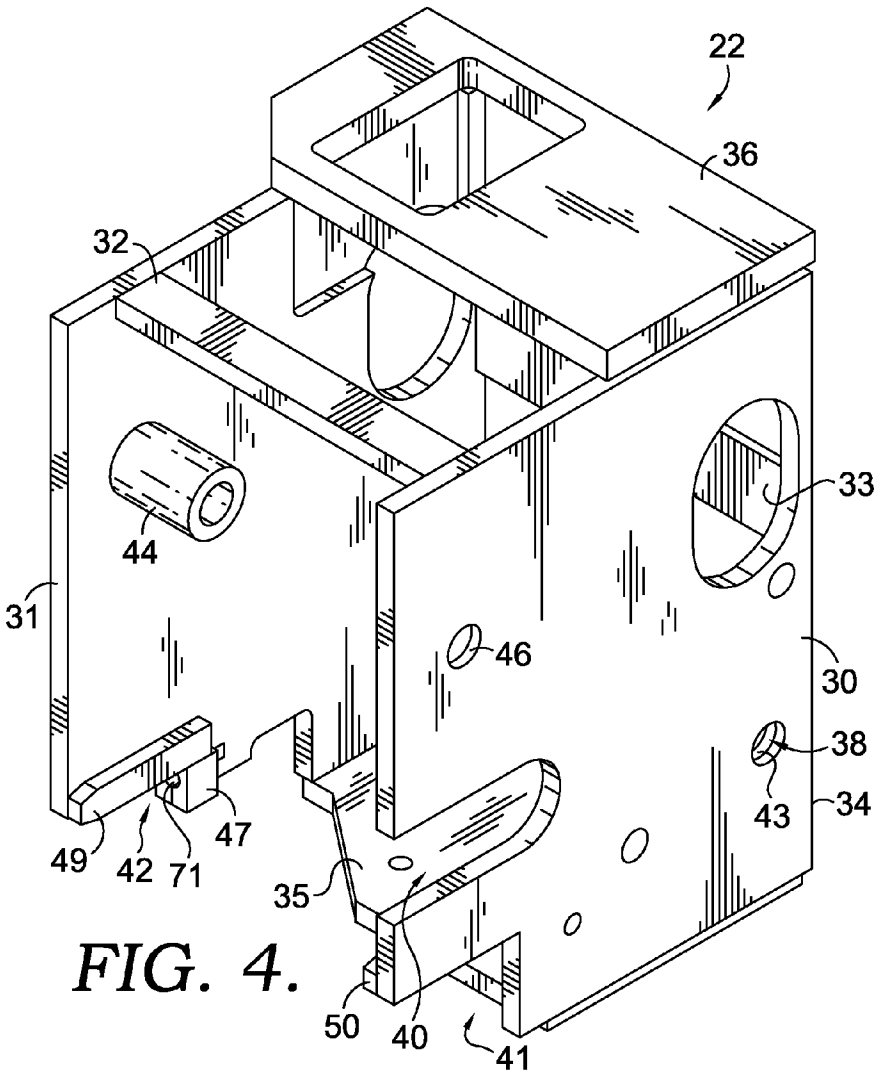
FIG. 4 depicts a perspective view of a frame assembly in accordance with embodiments of the present invention.
Figure 5:
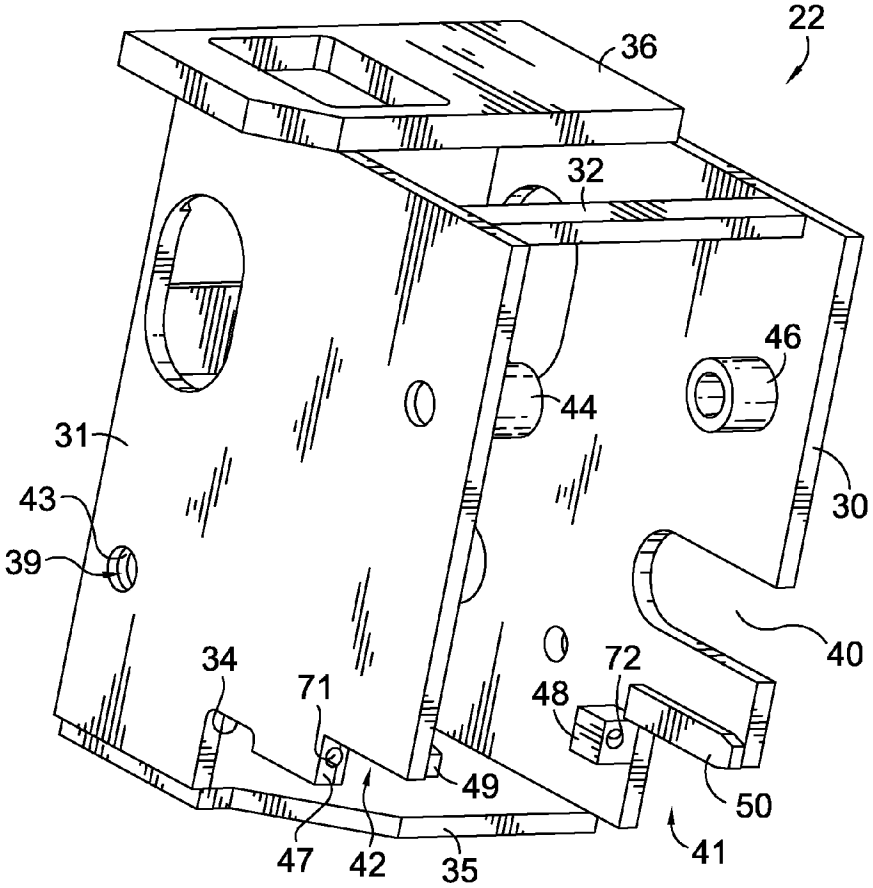
FIG. 5 depicts another perspective view of a frame assembly in accordance with embodiments of the present invention.

As best seen in FIGS. 4 and 5, the frame assembly 22 includes two parallel opposed frame walls: a cutter-side frame wall 30 and a gripper-side frame wall 31. A top brace 32 extends between the tops of the frame walls 30, 31 near the front of the frame assembly 22. Two back braces 33, 34 extend between the two frame walls 30, 31 across the back side of the frame assembly 22. Additionally, the frame assembly 22 includes a base plate 35 and a cylinder mount 36.

The cutter-side frame wall 30 includes an aperture 38 and spacer plug 43 for pivotably coupling one end of a torque tube 128 to the frame assembly 22. Similarly, the gripper-side frame wall 31 includes an aperture 39 and spacer plug 43 for pivotably coupling the other end of the torque tube 128 to the frame assembly 22. Spacer plugs 44, 46 are provided for pivotable attachment of a segment gear bearing housing 210 to the frame assembly 22.

An open slot 40 extends from the front of the cutter-side frame wall 30 to allow for travel of a cutter-lever cam assembly 79. As is further illustrated, two notches 41, 42 are provided in the lower-front portion of the frame walls 30, 31, respectively, for allowing removable attachment of the twist module assembly 23 to module mount blocks 47, 48 along twist module guide rails 49, 50.

Figure 7:
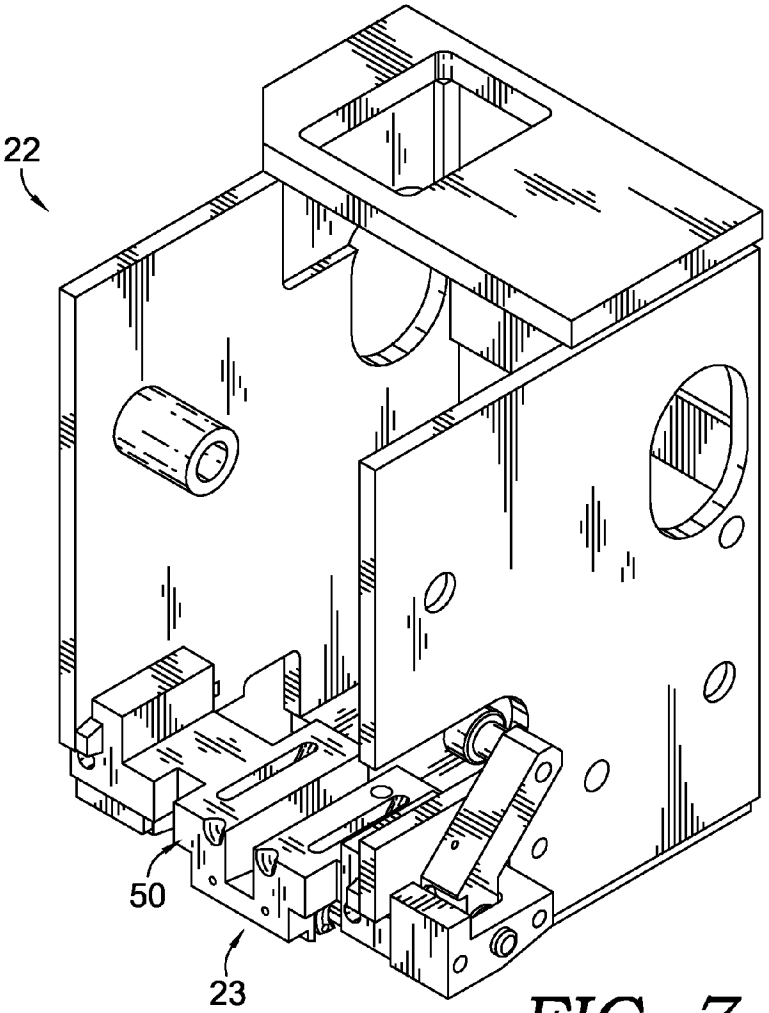
FIG. 7 depicts another perspective view of a frame assembly and a twist module assembly in accordance with embodiments of the present invention.
Figure 6:
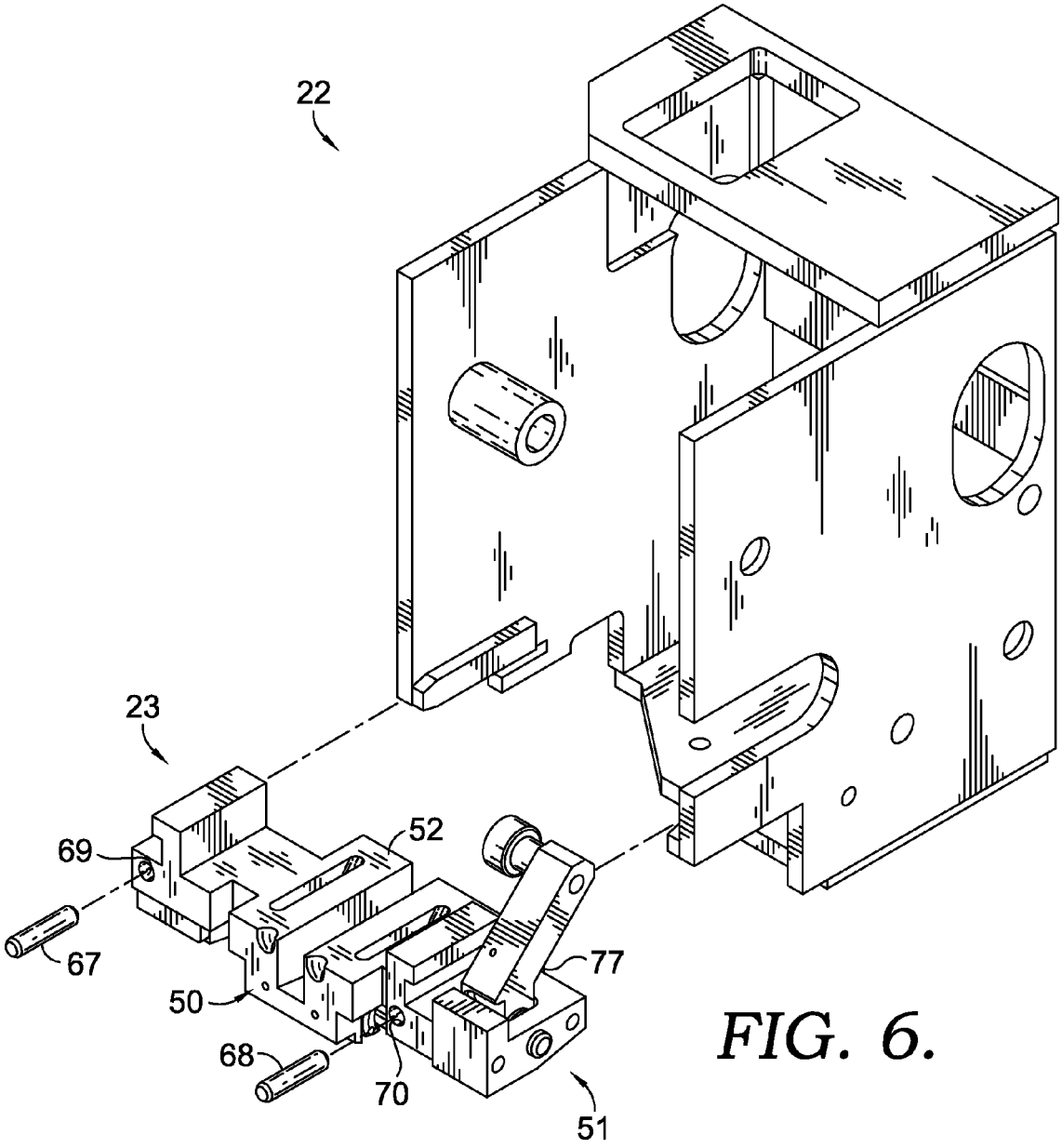
FIG. 6 depicts a perspective view of a frame assembly and a twist module assembly in accordance with embodiments of the present invention.

Turning now to FIGS. 6 and 7, a front perspective view of the frame assembly 22 and the twist module assembly 23 is shown in accordance with embodiments of the inventions. As illustrated and explained further below, the twist module assembly 23 is configured to be removably coupled to the frame assembly 22. The twist module assembly 23 includes a modular housing 52 that is slidably removable from the frame assembly 22. A cutter assembly 51 is attached at a first end of the modular housing 52 (i.e., the cutting side).

Figure 8:
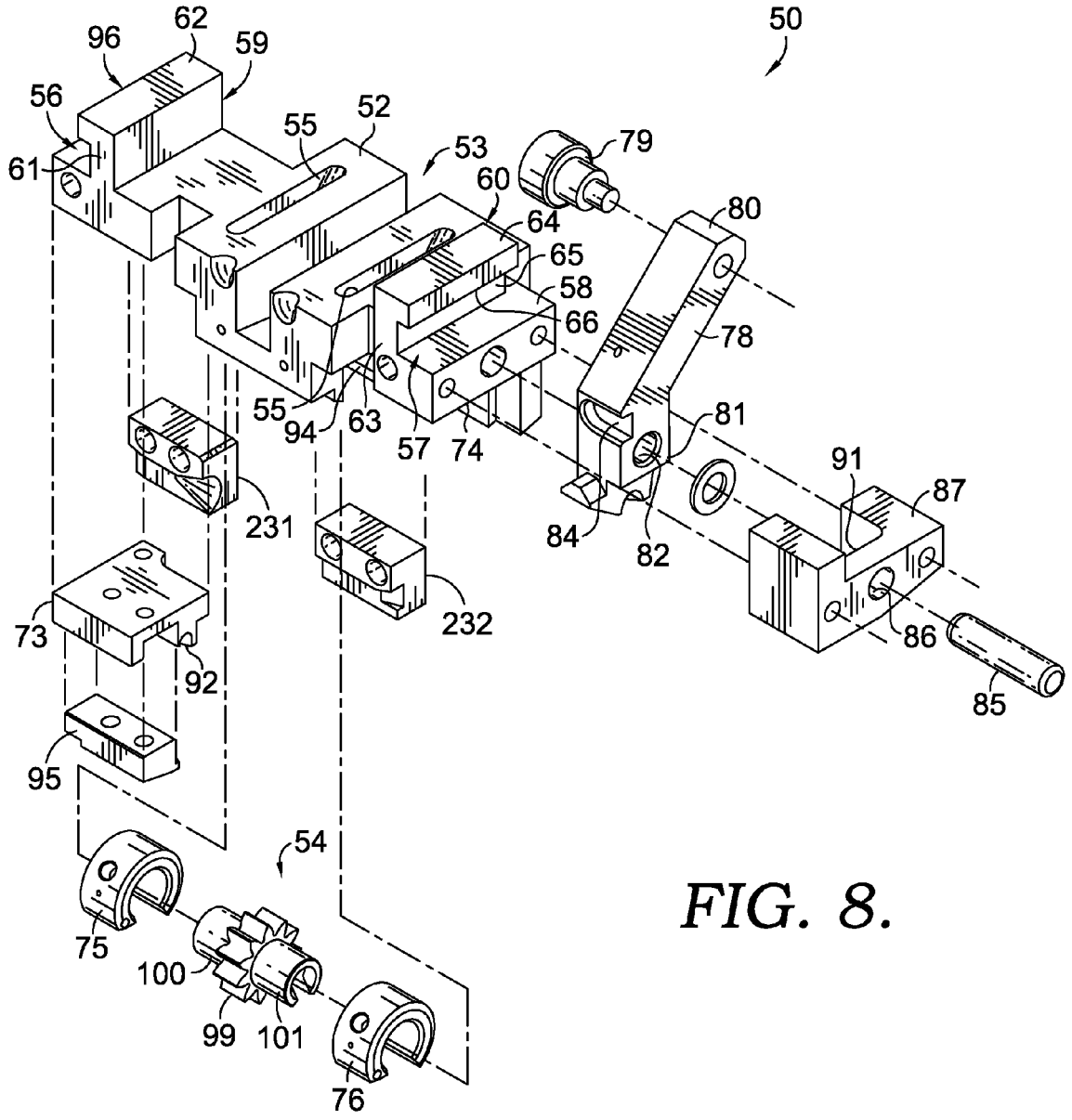
FIG. 8 depicts an exploded perspective view of a twist module assembly in accordance with embodiments of the invention.
Figure 9:
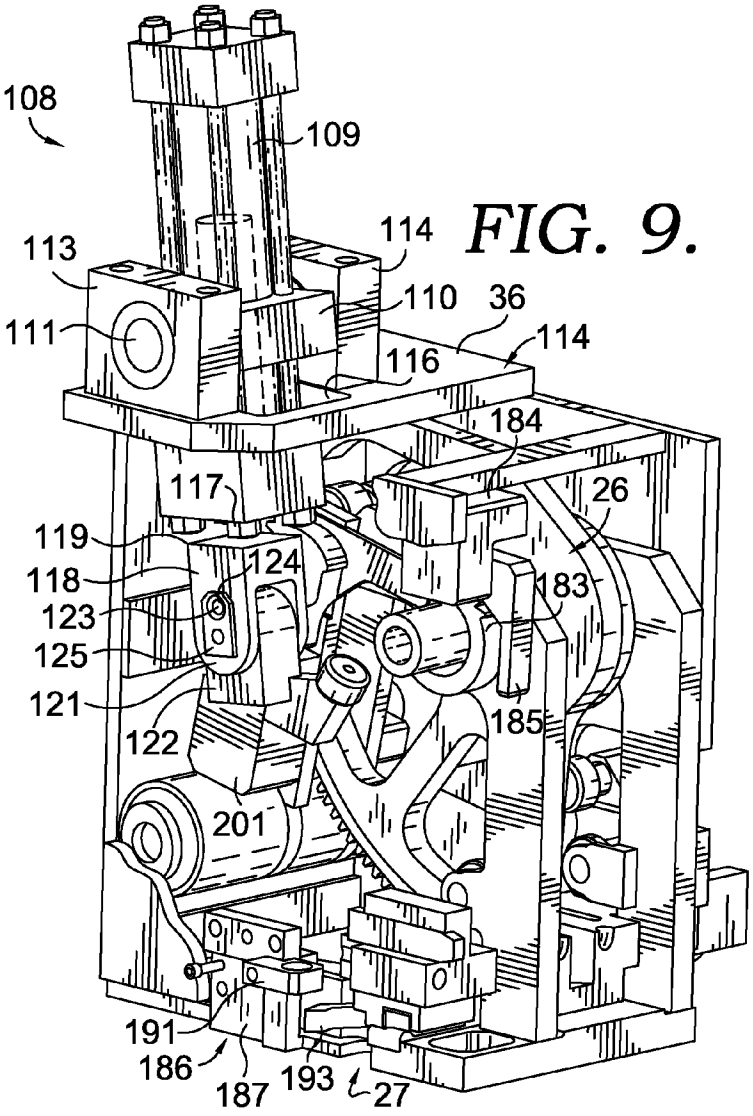
FIG. 9 depicts a partially cut-away perspective view of a knotter assembly in accordance with embodiments of the invention.

As shown in FIGS. 8-9, the modular housing 52 includes a recess 53 in which a twister pinion 54 is disposed. The modular housing 52 further includes an ejector slot 55 disposed on each side of the recess 53 and oriented parallel to the recess 53. As is further shown in FIGS. 6 and 8, the modular housing 52 includes two opposed mounting channels 56, 57. Each mounting channel 56, 57 is a void defined by a top surface 58 of the modular housing 52 (forming the bottom of the channel), and at least one surface of a module-mounting member 59, 60. Each module-mounting member 59, 60 is, in embodiments, L-shaped and includes a first portion 61, 63 extending vertically from the upper surface 58 of the modular housing 52 and a second portion 62, 64 extending laterally away from the first portion 61, 63 forming channels 56, 57, defined by the void between the upper surface 58 of the modular housing 52, the outside surface 65 of the first portion 61, 63 of the module-mounting member 59, 60 and the lower surface 66 of the second portion 62, 64 of the module-mounting member 59, 60. According to various embodiments of the inventions, the module-mounting members 59, 60 can be other shapes, as well, so long as the channels 56, 57 formed thereby mate with guide rails 49, 50.

The modular housing 52 is coupled to the frame assembly 22 by sliding the modular housing 52 onto the frame assembly 22. This slidable coupling is achieved by aligning each of the mounting channels 56, 57 with a corresponding guide rail 49, 50 and sliding the module-mounting members 59, 60 onto the respective guide rails 49, 50 such that the guide rails 49, 50 occupy the channels 56, 57. The modular housing 52 is temporarily secured into place with two connectors 67, 68 such as, for example, bolts or other coupling devices, that are inserted into bores 69, 70 and pass into threaded bores 71, 72 of mounting blocks 47, 48. In this manner, the modular housing 52 (and thus, the twist module assembly 23) can be easily removed and replaced by removing the two connectors 67, 68 and sliding the modular housing 52 off of the guide rails 49.

Figure 15:
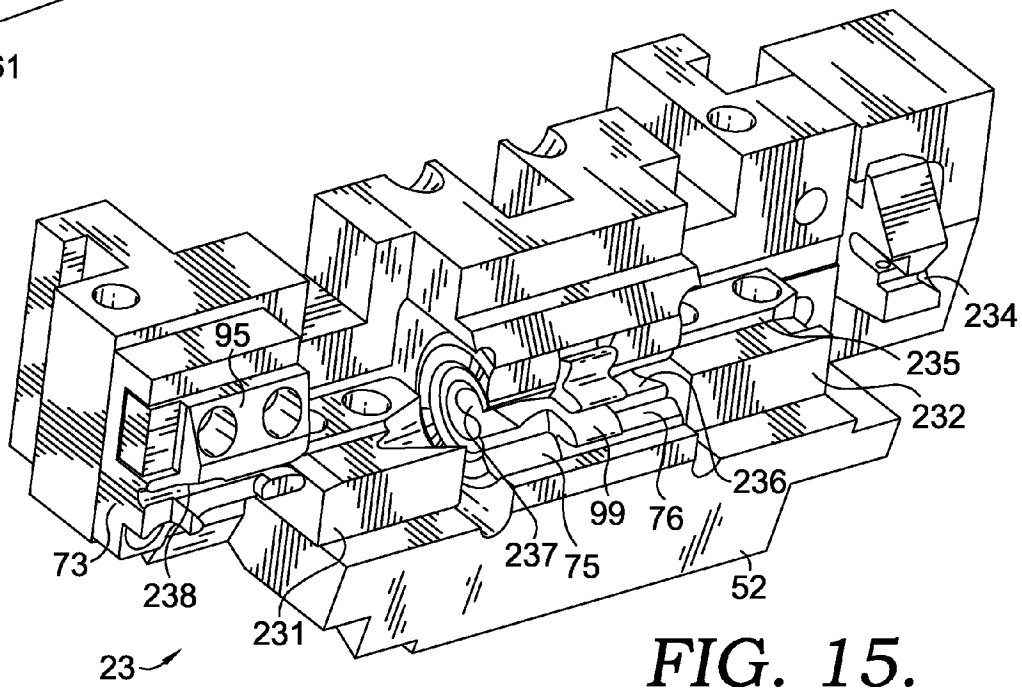
FIG. 15 depicts a perspective view of a twist module assembly, showing wire-guiding and twisting components in accordance with embodiments of the invention.

With particular reference to FIGS. 8 and 15, the twist module assembly 23 further includes wire guides 73, 74 forming wire paths 238 and 239, a gripper side yolk 95, wire guide blocks 231, 232 forming wire paths 236 and 237, a twister pinion 54, and two pinion bushings 75, 76. These components 54, 73, 74, 75, 76, 231, and 232 are known in the art and one having skill in the art will readily appreciate that components such as the components 54, 73, 74, 75, 76, 231, and 232 generally are gauge-specific and subject to wear from normal operation. In conventional knotter assemblies, each of these components 54, 73, 74, 75, 76, 231, and 232 (and, in some cases, additional components) is configured for a particular size (e.g., gauge) of wire. Therefore, in order to change the size of wire being used with conventional balers, each of these components 54, 73, 74, 75, 76, 231, and 232 had to be removed and replaced with similar components manufactured for the desired wire gauge. Moreover, these components tend to wear quickly. To better address these issues, the twist module assembly 23 can be quickly removed from the frame assembly 22 in embodiments of the present invention, and replaced with a new twist module assembly 23 having appropriately sized components, or having new or repaired components.

The cutter assembly 51 is attached to a first end 77 of the main block 52, as shown in FIG. 8. The cutter assembly 51 includes a cutting lever 78 having a laterally extending cam assembly 79 attached to the upper end 80 thereof. The cutting lever 78 is attached to the main block 52 by a pivot pin 85, which passes through a bore 86 in a U-shaped cutter mounting block 87 and through a bore 82 in the lower end 81 of the cutting lever 78 such that the cutting lever 78 pivots about the pivot pin 85. Connecting devices (not shown) such as, for example, bolts or other couplers, extend through bores in the mounting block 87 and into corresponding bores in the main block 52. A spring mechanism (not shown) is seated within the spring-receiving recess 84, at a first end and engages, at a second end, the inner face 91 of the mounting block 87.

As indicated above, the twist module 23 includes a pair of wire guides 73, 74, which are attached to the main block 52 on opposite sides of the twister pinion 54. Each of the wire guides 73, 74 includes an open lower portion 92 that provides a passageway for wires. The twist module assembly 23 also includes a right-hand wire guide block 232 that has a wire passageway. The right-hand wire guide block 232 is attached to the lower surface 94 of the modular housing 52 between the wire guide 73 and the lower end 81 of the cutter lever 78. The twist module assembly 23 also includes a left-hand wire guide block 231, which is attached to the left-hand end 96 of the modular housing 52. The twist pinion 54 includes a pinion gear 99 and support sections 100, 101 extending laterally away from the pinion gear 99. The arcuate bushings 75, 76 engage the support sections 100, 101 and are coupled to the main block 52 by connecting devices (not shown).

Figure 10:
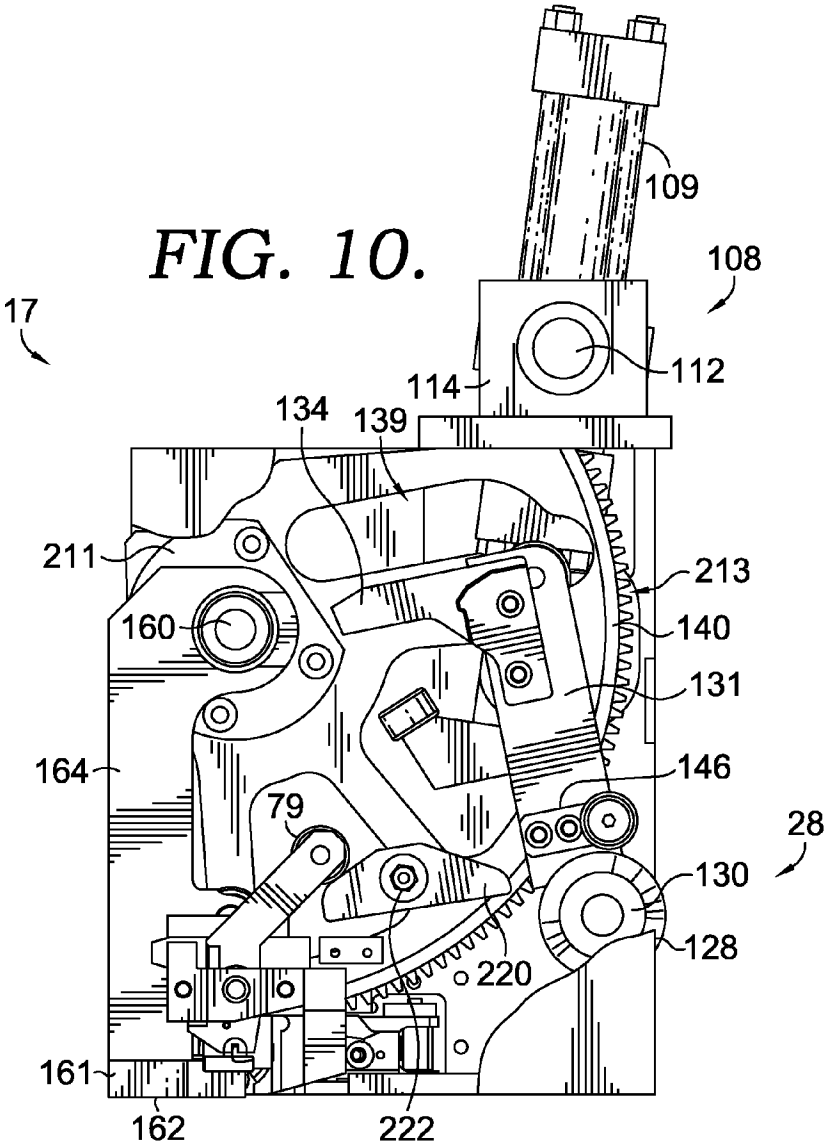
FIG. 10 depicts a side view, with a side wall removed, of a knotter assembly in accordance with embodiments of the invention.

As is best seen in FIGS. 9 and 10, the knotter assembly 17 generally includes a drive assembly 108, which includes a hydraulic cylinder 109. A coupling block 110 is disposed around the cylinder 109. The coupling block 110 includes a pair of cylinder pivot bearings 111, 112 that extend laterally away from the coupling block 110 and that are pivotably coupled to a pair of corresponding cylinder mount blocks 113, 114. The cylinder mount blocks 113, 114 are attached to an upper surface 114 of the frame cylinder mount 36. The cylinder 109 extends through an opening 116 defined within the frame cylinder mount 36 such that the cylinder 109 can pivot relative to the blocks 113, 114 and the frame cylinder mount 36. The drive assembly 108 also includes a piston rod 117 slidably disposed partially within the cylinder 109. A clevis 118 is secured, at an upper end 119, to a lower end 120 of the piston rod 117. The clevis 118 is pivotably coupled, near a lower end 121 to a gripper-release bearing block 122 using a clevis pin 123 that passes through apertures 124 on the clevis 118. A clevis pin tab 125 is secured to an outside surface of the clevis 118 for holding the clevis pin 123 in place. The gripper-release bearing block 122 is fixably attached to an upper surface of the gripper-release block 201, which is described in greater detail below.

Figure 11:
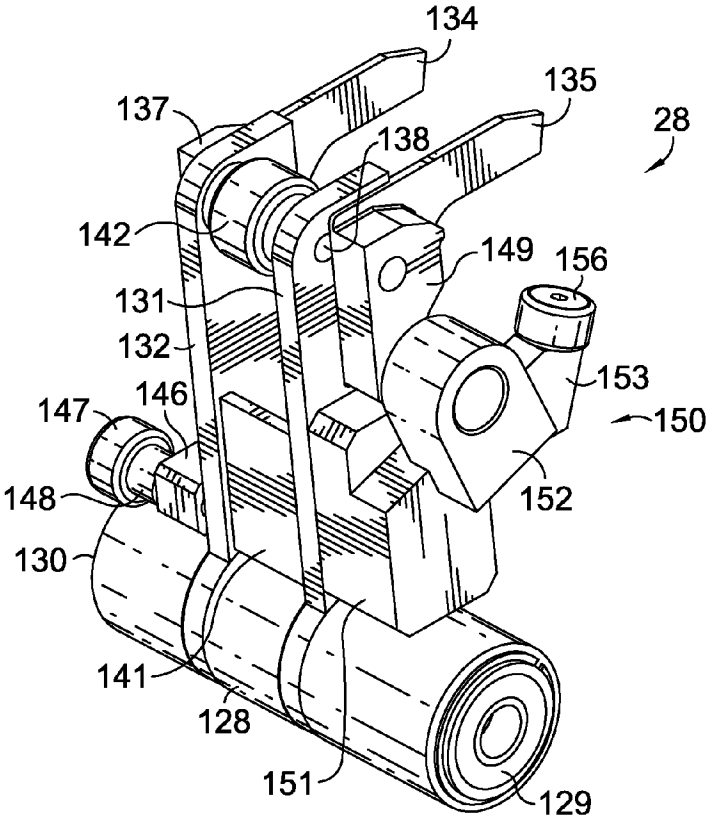
FIG. 11 depicts a perspective view of a torque tube assembly in accordance with embodiments of the invention.

As illustrated, for example, in FIGS. 9-11, the torque tube assembly 28 includes a torque tube 128 rotatably mounted within the frame assembly 22. A spacer plug 43 is disposed between each end of the torque tube 128 and the inside surface of the corresponding frame side 30, 31. The spacer plugs 43 are coupled to torque tube bearings 129, 130, each of which extends into the respective end of the torque tube 128, supporting the torque tube 128 such that the torque tube 128 can rotate about an axis oriented lengthwise through the center of the torque tube 128. In an embodiment, a total of two operating arms 131, 132 are fixedly attached to the torque tube 128 in a spaced relationship along the length thereof. The two operating arms 131, 132 are mating segment gear and ejector operators.

Figure 12:
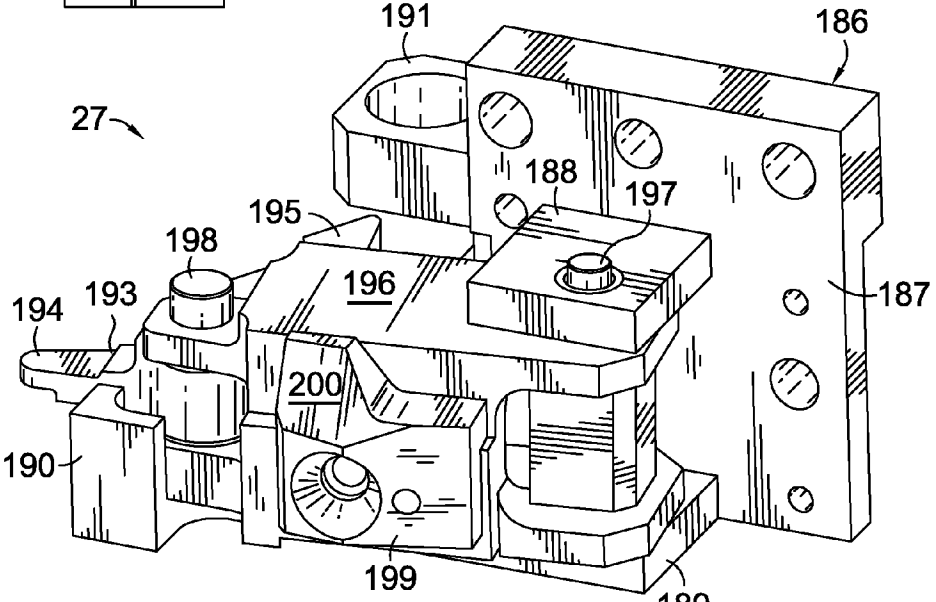
FIG. 12 depicts a perspective view of a gripper assembly in accordance with embodiments of the invention.

Two operating arms 131, 132 are attached to the torque tube 128, in accordance with embodiments of the inventions: a right-hand operating arm 131 and a left-hand operating arm 132. As seen in FIG. 12, each of the operating arms 131, 132 is fixably attached, at a first end thereof, to the torque tube 128 and extends away from the torque tube 128. Each operating arm 131, 132 includes a wire ejector finger 134, 135 attached at a second end and extending away therefrom in a generally perpendicular direction such that, in operation, the ejector fingers 134, 135 pass through the ejector slots 55 and engage the wire 19 to eject the wire 19 from the knotter assembly 17.

Figure 20B:
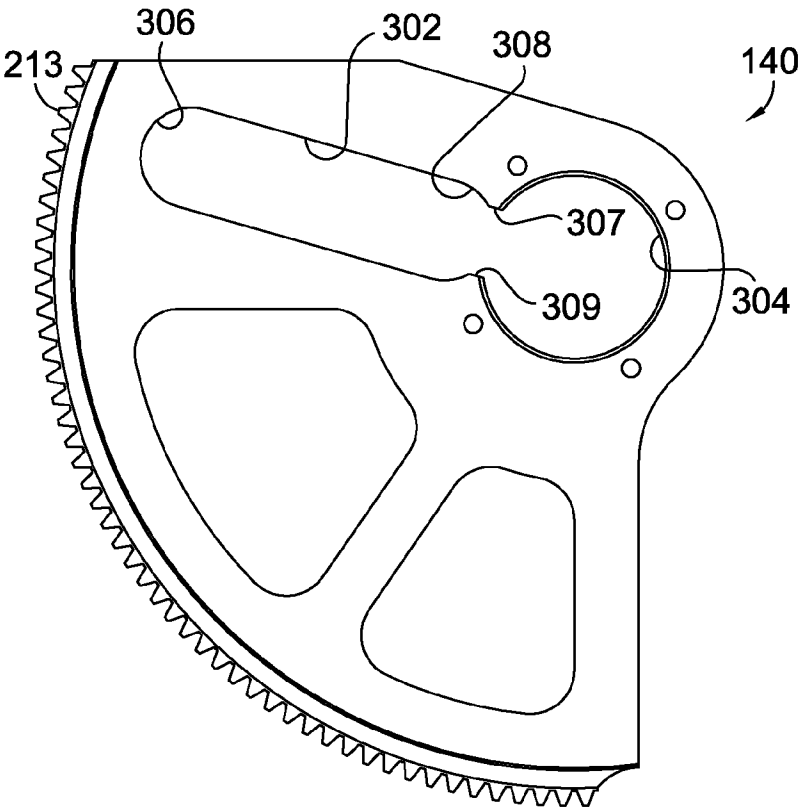
FIG. 20B depicts a perspective view of a segment gear with a straight slot in accordance with embodiments of the invention.

A roller cam 137 is rotatably disposed between the second ends 136 of the operating arms 131, 132. A camroll shaft 138 extends through the roller cam 137 and is affixed, at each end, to an operating arm 131, 132 such that the roller cam 137 rotates about the camroll shaft 138. The roller cam 137 engages an arcuate slot 139 defined within the segment gear 140. In another embodiment, the roller cam 137 engages a straight slot 302 defined within the segment gear 140, as illustrated in FIG. 20B.

As is further illustrated in FIG. 11, the right-hand operating arm 131 includes a first rocker block 142 attached to the outside surface of the arm 131 and near the second end thereof. Similarly, the left-hand operating arm 132 includes a second rocker block 144 attached to the outside surface of the arm 132 and near the second end thereof. As best seen in FIGS. 2A, 3, and 10, the right-hand operating arm 131 includes a cutter-operating cam mount 146 attached to the outside surface of the arm 131 and near the first end thereof. A cutter-operating cam 147 is rotatably mounted on a cutter-operating cam shaft 148 that extends laterally away from the outside surface of the mount 146. The cutter-operating cam 147 engages a cutter-operator block 220 on a first upward-inclined surface 221 thereof. The cutter-operator block 220 pivots about a bushing 222 such that a second upward-inclined surface 223 engages a cutter-lever cam assembly 79 to cut the wire 19.

As is further illustrated in FIG. 11, the left-hand operating arm 132 includes a gripper-release assembly 150. The gripper-release assembly 150 includes a gripper-release block 151, a gripper-release bearing block 152, and a gripper release operator 153, which is attached, at a first end, to a forward surface of the gripper-release bearing block 152. A gripper release cam 156 is rotatably mounted on a gripper release shaft 157 extending from the second end 158 of the gripper-release operator 153.

Upon extension or retraction of piston rod 117, the entire torque tube assembly 28 is correspondingly pivoted about a rotational axis oriented lengthwise through the center of the torque tube 128. The various operating components carried by the operating arms 131, 132 operate, on a sequential basis, the various assemblies described herein for causing the gripping, knotting, cutting and ejecting of a bale wire. This operation will be described in further detail below.

The segment gear assembly 24 is best seen in FIGS. 1, 2, and 10. The segment gear assembly 24 includes a segment-gear bearing housing 210, a segment-gear hub 211, and a segment gear 140. The segment-gear bearing housing 210 houses a segment gear bearing 212. The segment gear assembly 24 includes a segment gear 140 having a toothed face 213 that engages the pinion gear 99. The segment gear 140 further includes an elongated drive slot 139. The segment gear 140 is rotatably coupled to a transverse support shaft 160, which is rotatably coupled at each end to the frame walls 30, 31 such that the support shaft 160 pivots in conjunction with the segment gear 140.

In some embodiments, the segment gear assembly 24 includes a segment gear 140 having a straight drive slot 302, as illustrated in FIG. 20B. The segment gear 140 has a toothed face 213 that engages the pinion gear 99. The straight drive slot 302 of the segment gear 140 is used to actuate the segment gear 140. The segment gear 140 with the straight drive slot 302 is sized to perform four twists (as opposed to, for example, a 3¼ twist design). In this regard, the segment gear 140 with the straight drive slot 302 has a specific number of teeth, a specific outer perimeter size of the toothed face 213, a specific distance from a center rotational axis to the outer perimeter of the toothed face 213, and/or the like.

Figure 20A:
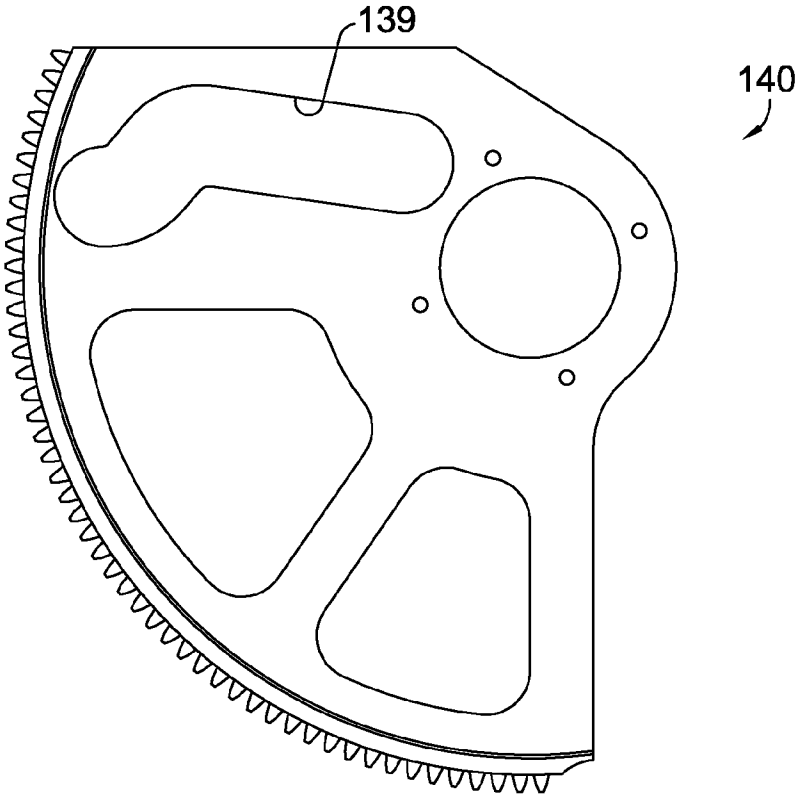
FIG. 20A. (PRIOR ART)
FIG. 20A depicts a perspective view of a segment gear with an arcuate slot in accordance with embodiments of the invention.
Figure 21:
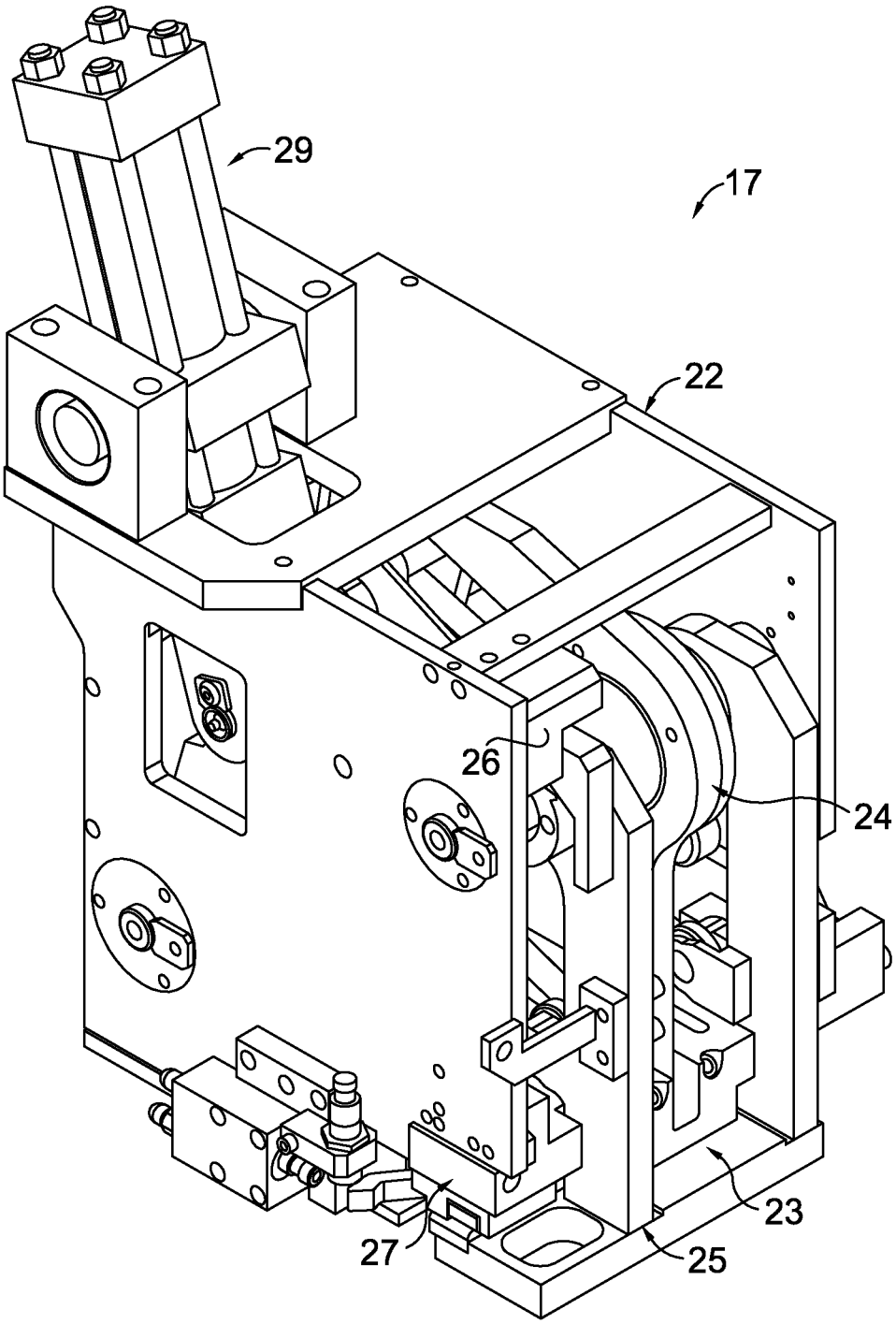
FIG. 21 depicts a perspective view of a modular knotter assembly in accordance with embodiments of the invention.

A straight-slot design within a segment gear provides advantages over an arcuate or a non-straight slot of the type illustrated in FIG. 20A. For example, utilization of the arcuate slot 139 of segment gear 140 in FIG. 20A results in a quick rotation or motion including the beginning and ending points of a four-twist cycle.

By comparison, the straight-slot design illustrated in FIG. 20B enables a slower beginning and ending speed which provides less impact to portions of the knotter assembly, such as the hydraulic cylinder. That is, the straight drive slot 302 minimizes unnecessary accelerations at the beginning and ending of a cycle, which results in a more robust design and a smoother operation for generating a four (or more) twist knot. The geometry of the straight-slot design provides a cushion-like start and stop to the rotation of the segment gear 140 over the prior art arcuate or a non-straight slot design illustrated in FIG. 20A. In accordance with the segment gear 140 illustrated in FIG. 20B, roller cam 137 of the torque tube assembly is initially positioned toward the outer portion of the straight drive slot 302 and moves towards the center axis of the segment gear 140. In this regard, as the torque tube assembly pivots forward, the roller cam 137 translates down the straight drive slot 302 towards aperture 304 to generate rotation of the segment gear 140.

As can be appreciated, the straight-slot design illustrated in FIG. 20B is configured to perform a four-twist knot. In embodiments, to attain a four-twist knot, the segment gear 140 requires four times the number of teeth on the surface as the number of teeth used by the twister pinion 99. In cases where the twister pinion 99 has twelve teeth, the segment gear 140 has 48 teeth on the outer surface to enable a four-twist knot.

Accordingly, to attain a four-twist knot with a controlled (e.g., slower) motion at the beginning and end of the twist knot cycle, straight drive slot 302 is geometrically positioned within the segment gear 140 that is sized and shaped to accommodate a four-twist design. In one embodiment, as illustrated in FIG. 20B, the segment gear 140 includes a tooth face 213 having 48 teeth. The segment gear 140 rotatably couples to the traverse support shaft 160 via aperture 304 positioned at the center axis of rotation of segment gear 140. The straight drive slot 302 extends from aperture 304 at an upwards angle. The straight drive slot 302 has an enclosed outer end 306 positioned near the tooth face 213 of the segment gear 140 and an inner end 308 adjoining with aperture 304. As illustrated in FIG. 20B, the inner end 308 includes a first lip 307 and a second lip 309 that protrude inward from the edge of the straight drive slot 302. The first lip 307 and the second lip 309 form a boundary between the straight drive slot 302 and the aperture 304. As such, the first lip 307 and the second lip 309 can prevent the roller cam 137 from rotating into the aperture 304. The length of the straight drive slot 302 is appropriately sized to enable a four-twist knot. Such a design enables the straight drive slot 302 to fit within the space of the segment gear 140 that is sized for generating four-twist knots. As can be appreciated, the straight drive slot 302 can be sized and positioned in any manner that fits within the segment gear 140 to facilitate a four-twist design.

Figure 14:
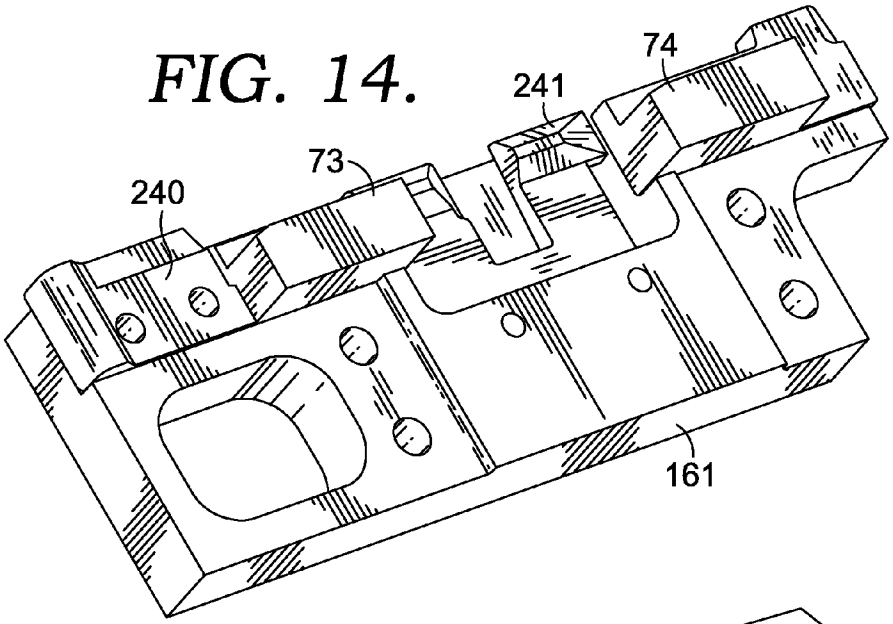
FIG. 14 depicts a perspective view of a cover plate, showing wire-guiding and twisting components in accordance with embodiments of the invention.

As is best seen in FIGS. 2A, 2B, 3, and 10, the knotter arm assembly 25 includes a knotter cover 161 which is generally disposed beneath the knotter assembly 17. The knotter cover 161 includes an apertured plate 162 such as is illustrated in FIG. 9. The knotter cover 161, as shown in FIG. 14, includes a pair of wire guides 73, 74, a central finger 241, and a fixed gripper 240. As further illustrated in FIG. 16, when the cover 161 is closed, the elements attached to the cover meet with the elements disposed on the twist module assembly 23 to create an overall wire path 248 defined throughout the various elements. A pair of knotter-cover arms 163, 164 are fixed, at a lower end, to an upper surface of the knotter cover 161 and extend upwardly away from the knotter cover 161. At an upper end, each knotter arm 163, 164 is pivotably coupled to a segment-gear bearing housing 210, which is pivotably coupled, using a pair of spacer plugs 44, 45 to a frame side 30, 31. Each knotter arm 163, 164 has a knotter-arm cam side plate 169, 170 fixably attached to an inside surface 171, 172 of the corresponding knotter arm 163, 164. A protrusion 173, 174 extends laterally away from the rear surface of each knotter arm 163, 164. An operator bearing 177, 178 is disposed between knotter-arm cam side plate 169, 170 and the protrusion 173, 174 on each knotter arm 163, 164 and is rotatably coupled therein by way of an operator bearing shaft 181, 182.

Figure 19:
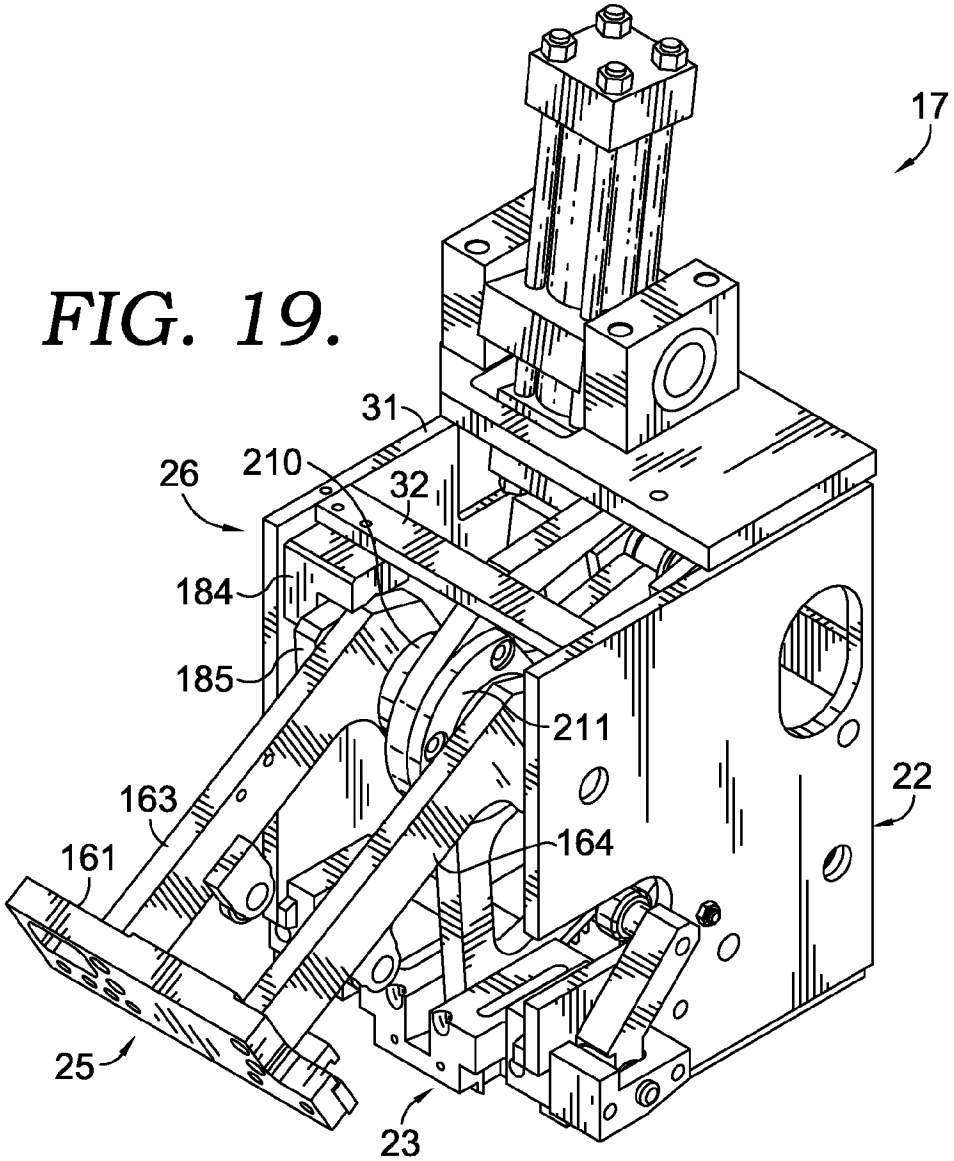
FIG. 19 depicts a perspective view of a knotter assembly with a cover assembly in an open position in accordance with embodiments of the invention.

The left-hand knotter arm 163 includes a ratchet assembly 26 that facilitates opening the knotter cover 161 and locking the knotter cover 161 in an open position such as the position illustrated in FIG. 19 for servicing. Additionally, as illustrated in FIG. 2B, a bias spring 260 biases the cover 161 toward a closed position. As shown, the bias spring 260 extends between a spring connector 261 that extends laterally away from a mount block 262 disposed on the outside surface of the left-hand knotter arm 163 and a stud 263 that is attached to the outside surface of the left-hand frame side wall 31.

Figure 17:
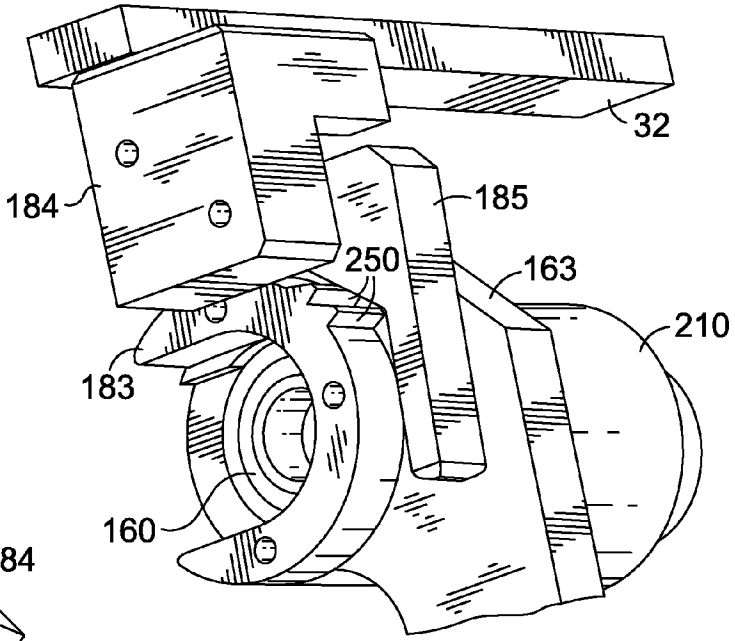
FIG. 17 depicts a perspective view of a ratchet assembly in accordance with embodiments of the invention.
Figure 18:
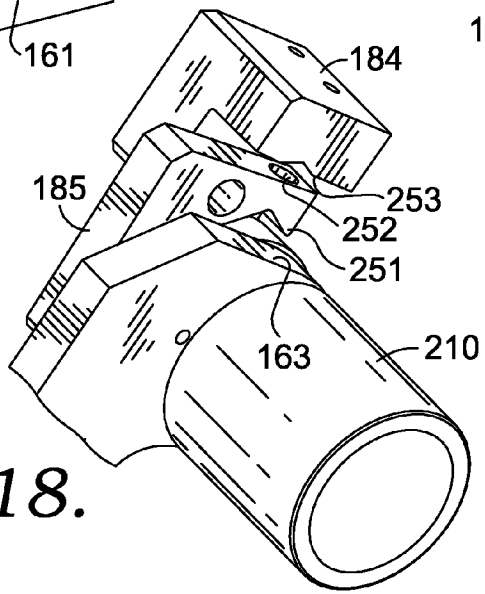
FIG. 18 depicts another perspective view of a ratchet assembly in accordance with embodiments of the invention.

As is best seen in FIGS. 17-19, the ratchet assembly 26 includes a ratchet gear 183 having one or more teeth 250 (e.g., two teeth), a ratchet latch mounting block 184, and a ratchet gear lever 185 having an engagement portion 251. The number of teeth 250 included on the ratchet gear 183 will depend upon the desired number of open positions associated with the knotter cover 161. In an embodiment, the ratchet gear 183 includes two teeth, thereby allowing for two different open positions.

As is best seen in FIG. 18, lever 185 includes a spring recess 252 that receives a spring (not shown, as these are well-known in the art) that extends between the top of the lever 185 and a recess 253 disposed in the underside of the ratchet latch mounting block. The spring causes a downward force on the lever 185, causing the engagement portion 251 of the lever 185 to act as a pawl that engages the teeth 250 on the ratchet gear 183. Thus, in embodiments and as depicted in FIG. 19, a user can lift the knotter cover 161 to a first or second open position. The operation described above of the ratchet assembly 26 locks the cover 161 in the selected position. In this manner, the user can service parts of the knotter assembly 17 such as, for example, by removing the twist module assembly 23 from the frame assembly 22 and replacing it with another twist module assembly 23 having new or repaired parts or parts designed for tieing wire of a different gauge.

Figure 13:
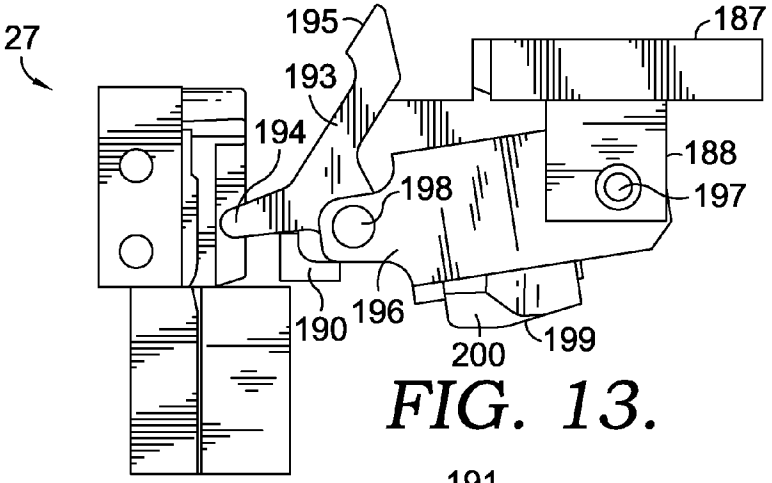
FIG. 13 depicts a top-plan view of a gripper assembly in accordance with embodiments of the invention.

The gripper assembly 27 is illustrated in FIGS. 9, 12, and 13. The gripper assembly 27 includes a connector 186. The connector 186 includes an upright plate 187. An upper aperture tab 188 and an opposed lower aperture tab 189 extend laterally away from the upright plate 187. A stop block 190 is fixably attached to the lower aperture tab 189. The upright plate 187 further includes a pair of spring recesses that receive a pair of coil springs, both of which are well-known in the prior art and, therefore, are not illustrated herein. The plate 187 is attached to the outside surface of frame side wall 31.

The gripper assembly 27 also includes a generally dogleg-shaped, wire-engaging member 193. The wire-engaging member 193 includes a wire-engaging end 194 and an actuator end 195. The wire-engaging member 193 is pivotably attached to a pivotal block 196 that is pivotably attached to the connector 186 by way of a pair of connection pins 197, 198. An operator segment 199 is secured to an outside surface of the block 193 and includes an inclined operating surface 200. The pivotal block 196 houses a spring assembly (not shown), as is known in the art. Additionally, those having skill in the art will appreciate that a biasing spring (not shown) may extend between the block 196 and the wire-engaging member 193 and that coil springs (not shown) may extend between the plate 187 and the block 196.

A sensor mounting block 191 is attached to an outside surface of the upright plate 187 and is configured for housing a sensor (not shown) that detects when the actuator end 195 of the wire-engaging member 193 moves to a position near the sensor due to the wire being in a grippable position so that the system can begin the process of reversing the feed direction of the wire to tension it, as is known in the prior art. Additionally, those having skill in the art will recognize that an extendable cylinder (not shown) may be attached to the outside of the upright plate 187 and aligned such that, when the cylinder is extended, the cylinder engages the actuator end 195 of the wire-engaging member 193 and pushes the actuator member 195 away from the cylinder, thereby causing the wire-engaging member 193 to pivot in a counterclockwise direction, gripping the wire.

An exemplary operation of baler 10 is described below. Initially, the wire 19 is manually fed through guides (not shown), and jogged around the bale via the track 18 using the pinch-roll mechanism 16 to slowly advance the wire 19, and into the gripper assembly 27, which grips the wire 19, to a "home" position such that the sensor associated with the gripper (discussed above, but not illustrated as it is well-known in the prior art) activates. Activation of the sensor communicates to the baler or an operator that the system 15 is ready to tie a bale. When a bale is properly positioned relative to the outlet 14 such that the wire-tieing system 15 is aligned with a first wire-tie position associated with the bale, the system 15 receives a manual or electronic input to initiate tieing. Upon receiving an input from the baler or operator, the gripper assembly's 27 grip on the wire 19 is tightened, the wire 19 is tensioned around the bale by a reverse action of the pinch-roller mechanism 16 that feeds wire into an accumulation area (not shown, as it is taught in the prior art) inside the feed and tensioning structure 21, and a twist knot is completed. Upon ejection, the wire 19 is automatically re-fed through the guides and track 18 to the gripped home position, activating the sensor to indicate that the system 15 is ready to tie. The operator or the baling machine 10 indexes the bale to a second (e.g., next) wire-tie location. As the system repeats itself from a ready status, a sensor (not shown) associated with the outlet 14 sends an initiation signal to wire-tieing system 15.

To prepare a wire 19 such that the system is in a home position, the pinch-roll mechanism 16 is actuated via a drive motor (not shown) to advance the wire 19, drawing wire 19 from the spool 20. The pinch-roll mechanism 16 advances the wire 19 through the knotter assembly 17, and around the guide track 18 until the leading end of the wire 19 passes underneath the wire 19 section already disposed within the knotter assembly 17.

The pinch-roll mechanism 16 continues advancing the wire 19 until the leading edge thereof passes and engages the wire-engaging end 194 of the wire-engaging member 193 of the gripper assembly 27. As a result, the wire-engaging member 193 slightly pivots in a clockwise direction. The wire-engaging end 194 engages the wire 19 and the actuator end 195 is located beneath the sensor (not shown). The sensor detects the presence of the actuator end 195 and causes a signal to be sent to the pinch-roll mechanism 16 to stop advancing the wire 19. The system 15 and wire 19 are now in a home, or ready, position.

Upon receiving a signal to tie, the pinch-roll mechanism 16 begins to reverse the advancement of the wire 19. This reverse advancement tensions the wire 19 around the track 18. As a result of its engagement with the wire 19, the wire-engaging member 193 pivots in a counterclockwise direction until the wire-engaging member 193 encounters stop block 190. The pinch-roll mechanism 16 continues the reverse advancement of the wire 19 to tighten the gripping engagement that the wire-engaging end 194 of the wire-engaging member 193 has with the wire 19. To ensure that the wire is gripped tightly enough for cutting, a cylinder (not shown) may be actuated, which engages the actuator end 195 of the wire-engaging member 193 and causes further counterclockwise pivoting of the wire-engaging member 193.

The drive assembly 108 is actuated to twist-knot the wire 19, to cut the wire 19, and to eject the knotted wire from the knotter assembly 17. In embodiments, the cylinder 109 and piston rod 117 mechanism is actuated, thereby causing the cylinder 109 to pivot relative to the mounting blocks 113, 114 and the frame cylinder mount 36. As a result, the clevis 118 causes the gripper-release bearing block 122 and gripper release block 151 to rotate, thereby rotating the torque tube assembly 28. In response to this rotation, the roller cam 137 rides within the drive slot 139, causing the segment gear 140 to pivot, thereby causing rotation of the pinion gear 99. The rotation of the pinion gear 99 causes the two portions of the wire 19 to be twisted together. In embodiments, for example, the portions of the wire 19 are twisted through four turns, while in other embodiments, the portions are twisted through three and one-quarter turns or some other number of turns.

After the wire 19 is twisted, the cutter lever 78 is actuated by engagement of block 220 with the cam 79 secured to the upper end 80 of the cutter lever 78, causing the cutter lever 78 to rock about the pivot pin 85, shearing the wire 19.

Figure 16:
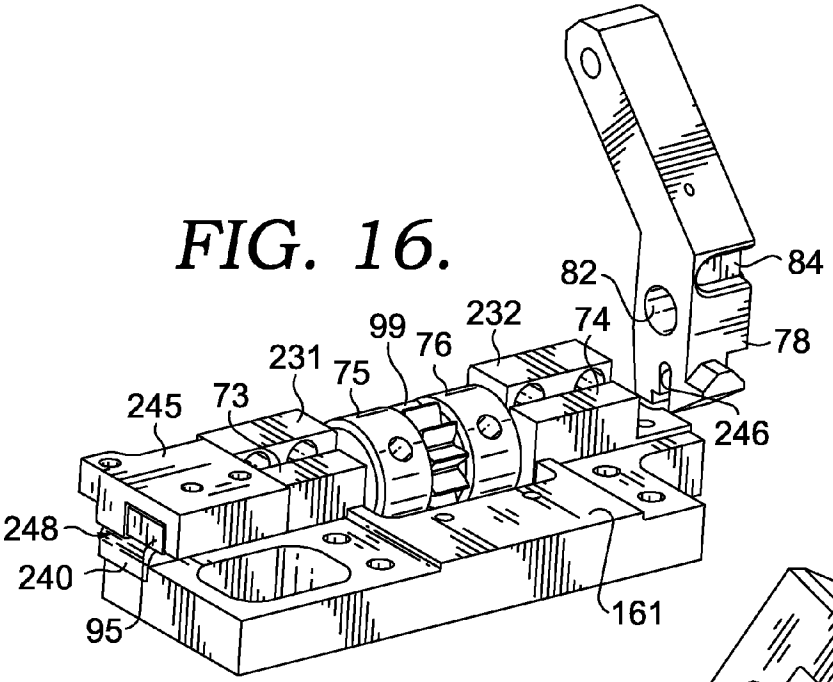
FIG. 16 depicts a perspective view of the mated wire-guiding and twisting components of a cover plate and a twist module assembly in accordance with embodiments of the invention.

Next, the gripper release block 151 is pivoted to cause its engagement with the operating surface 200 of the operator segment 199. As a result of this engagement, the pivotal block 196 is pivoted over center, releasing the wire 19 from the wire-engaging member 193. The knotter cover 161 is moved slightly upwardly to allow ejection of the wire 19. As illustrated in FIGS. 14-16, the slight upward movement of the knotter cover 161 is occurs as a result of the interaction of the rocker blocks 142, 144 carried by the operating arms 131, 132 with the operator bearings 177, 178 carried by the knotter-cover arms 163, 164. Additionally, the ejector fingers 134, 135 pass through the slots 55 to engage and eject the wire 19.

The device 10 is then returned to a ready position by actuation of the cylinder 109 and piston rod 117 mechanism to retract the piston rod 117 within the cylinder 109. As a result, the segment gear 140 and the components of the torque tube assembly 28 return to their original positions. The knotter cover 161 returns to its original position under the influence of gravity and additional assistance from the bias spring 260, which biases the cover 161 inwardly toward the frame assembly 22. The gripper assembly 27 also returns to its original position.

According to embodiments of the invention, the knotter cover 161 can be readily shifted to allow removal of the twist module assembly 23. In embodiments, a user lifts up on the knotter cover 161 through an arc of about sixty degrees. In some embodiments, the arc may include less than sixty degrees, while in other embodiments, the arc may include more than sixty degrees. The ratchet assembly 26 causes the knotter cover 161 to lock in place at one or more open positions. To lower the cover, the ratchet gear lever 185 is depressed to release the pawl on 185 from the ratchet gear 183 and the cover is lowered.

Moreover, because the twist module assembly 23 is removably coupled to the frame assembly 22, it is relatively simple to remove the connectors 67, 68 and slide the twist module assembly 23 off of the frame assembly 22. Once the twist module assembly 23 is removed, a new twist module assembly 23 (or, e.g., a twist module assembly with previously repaired parts) can be installed onto the frame assembly 22. In this manner, components of the twist module assembly 23 can be rapidly replaced when they wear, while minimizing machine 10 down-time. Additionally, this modular operation allows for rapidly switching the gauge of wire that is being used for baling.

FIGS. 21-34 provide perspective views of a modular knotter assembly design that enables assembly and disassembly of various components of a knotter assembly. In this regard, a user can remove various components from the frame assembly 22 by way of the front of the knotter assembly 17. The knotter assembly 17 broadly includes a frame assembly 22, a twist module assembly 23, a segment gear assembly 24, a knotter arm assembly 25, a ratchet assembly 26, a gripper assembly 27, a torque tube assembly 28, and a cylinder assembly 29. In embodiments, the modular knotter assembly 17 can include other assemblies and parts not illustrated herein.

Figure 22:
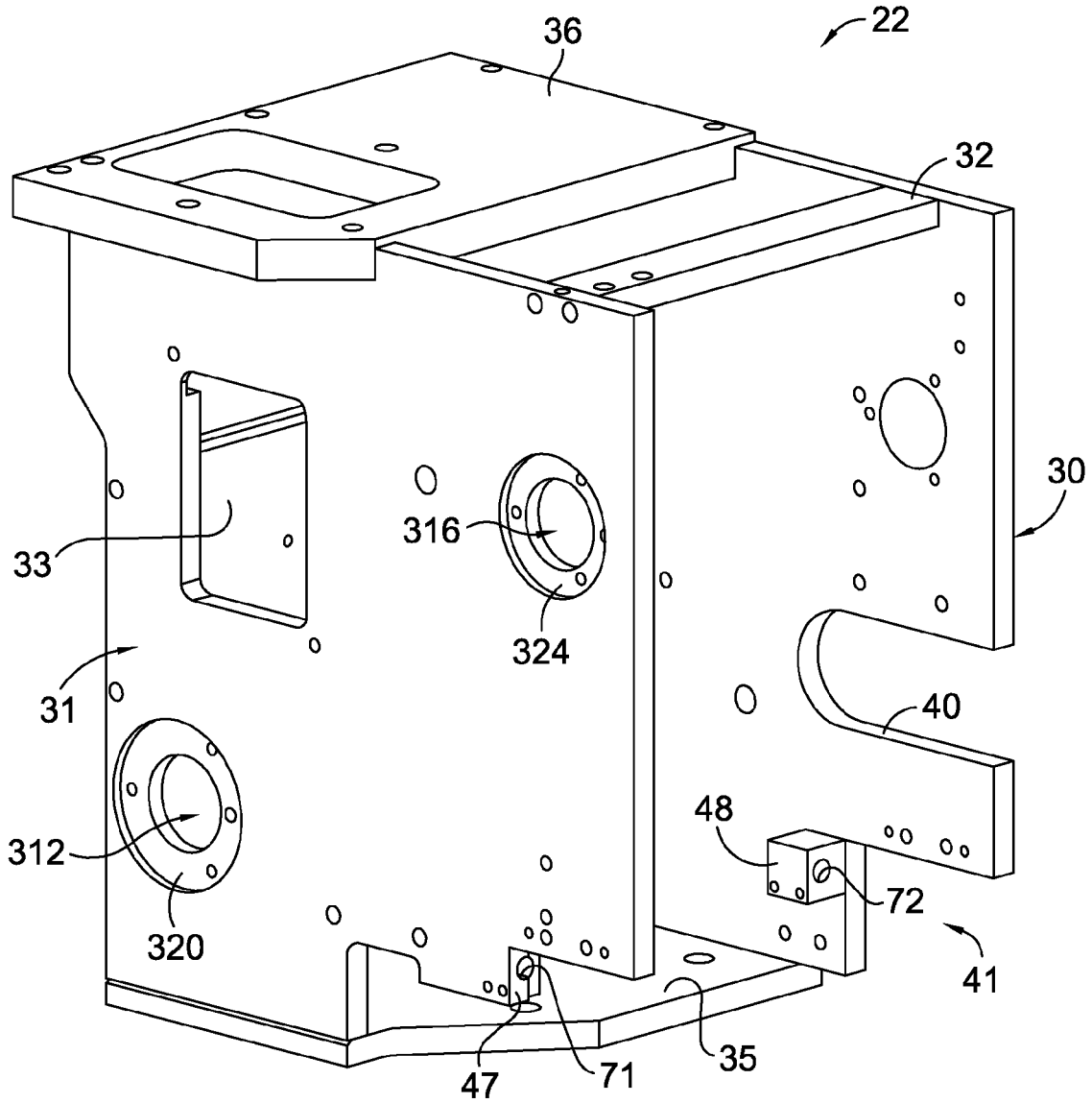
FIG. 22 depicts a top-left perspective view of a frame assembly for a modular knotter assembly in accordance with embodiments of the invention.
Figure 23:
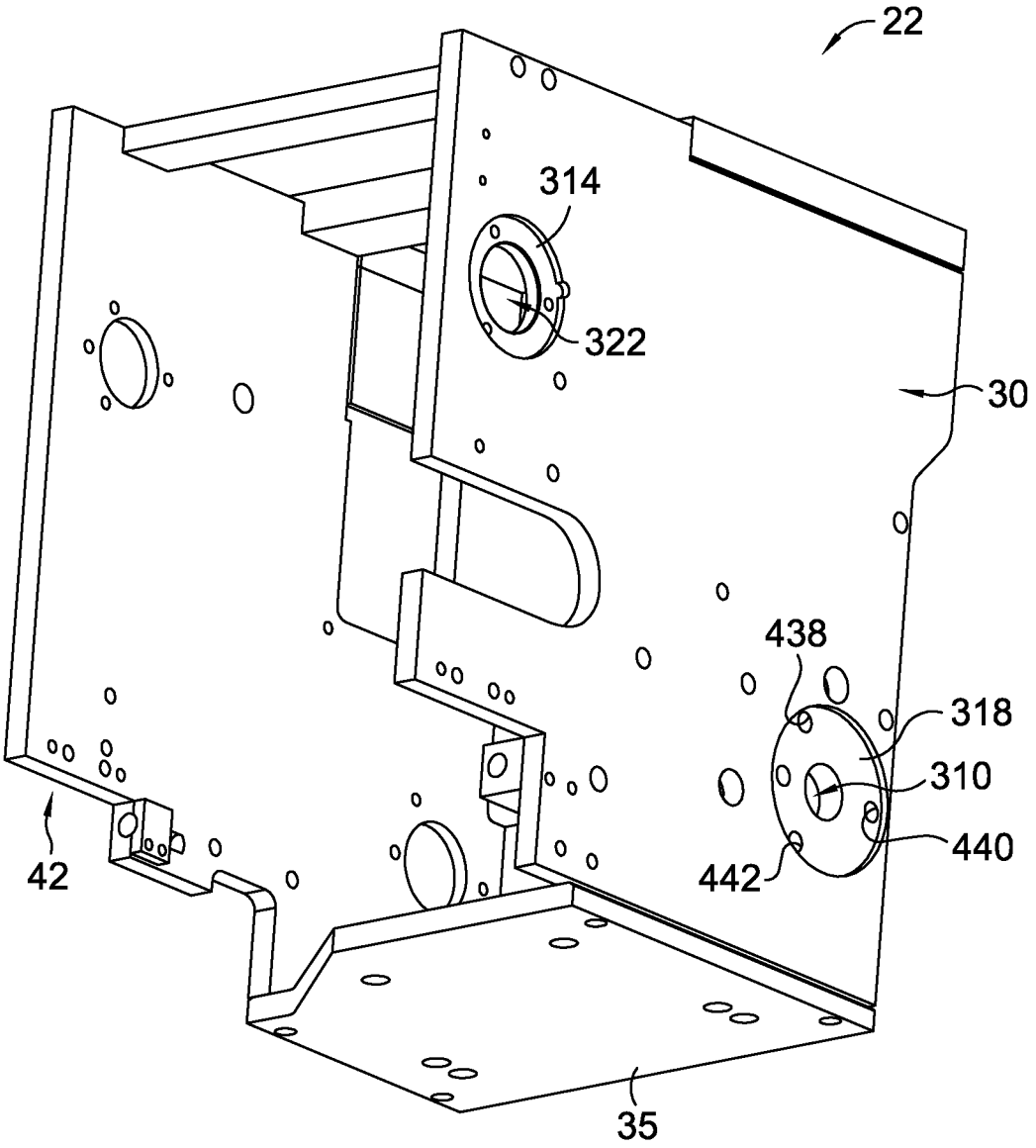
FIG. 23 depicts bottom right perspective view of the frame assembly of FIG. 22.

As is best seen in FIGS. 22-23, the frame assembly 22 includes two parallel opposed frame walls: a cutter-side fame wall 30 and a gripper-side frame wall 31. A top brace 32 extends between the tops of the frame walls 30, 31 near the front of the frame assembly 22. A back brace 33 extends between the two frame walls 30, 31 across the back side of the frame assembly 22. Additionally, the frame assembly 22 includes a base plate 35 and a cylinder mount 36.

The cutter-side frame wall 30 includes aperture 310 used to couple one end of a torque tube 128 to the frame assembly 22. Similarly, the gripper-side frame wall 31 includes an aperture 312 used to couple the other end of the torque tube 128 to the frame assembly 22. The cutter-side frame wall 30 also includes aperture 314 used to couple one end of the segment gear bearing housing 210 to the frame assembly 22. Similarly, the gripper-side frame wall 31 includes aperture 316 used to couple the other end of the segment gear bearing housing 210 to the frame assembly 22. Frame assembly 22 also includes recessed circular portions 318, 320, 322, and 324 that surround each of the apertures 310, 312, 314, and 316, respectively. Each of the recessed circular portions 318, 320, 322, and 324 have an inner circumference and an outer circumference with the inner circumference aligning with the corresponding aperture.

An open slot 40 extends from the front of the cutter-side frame wall 30 to allow for travel of the cutter-leveler cam assembly 79. As further illustrated, two notches 41, 42 are provided in the lower-front portion of the frame walls 30, 31, respectively, for allowing removable attachment of the twist module assembly 23 to module mount blocks 47, 48 along the twist module guide rails 49, 50.

Figure 24:
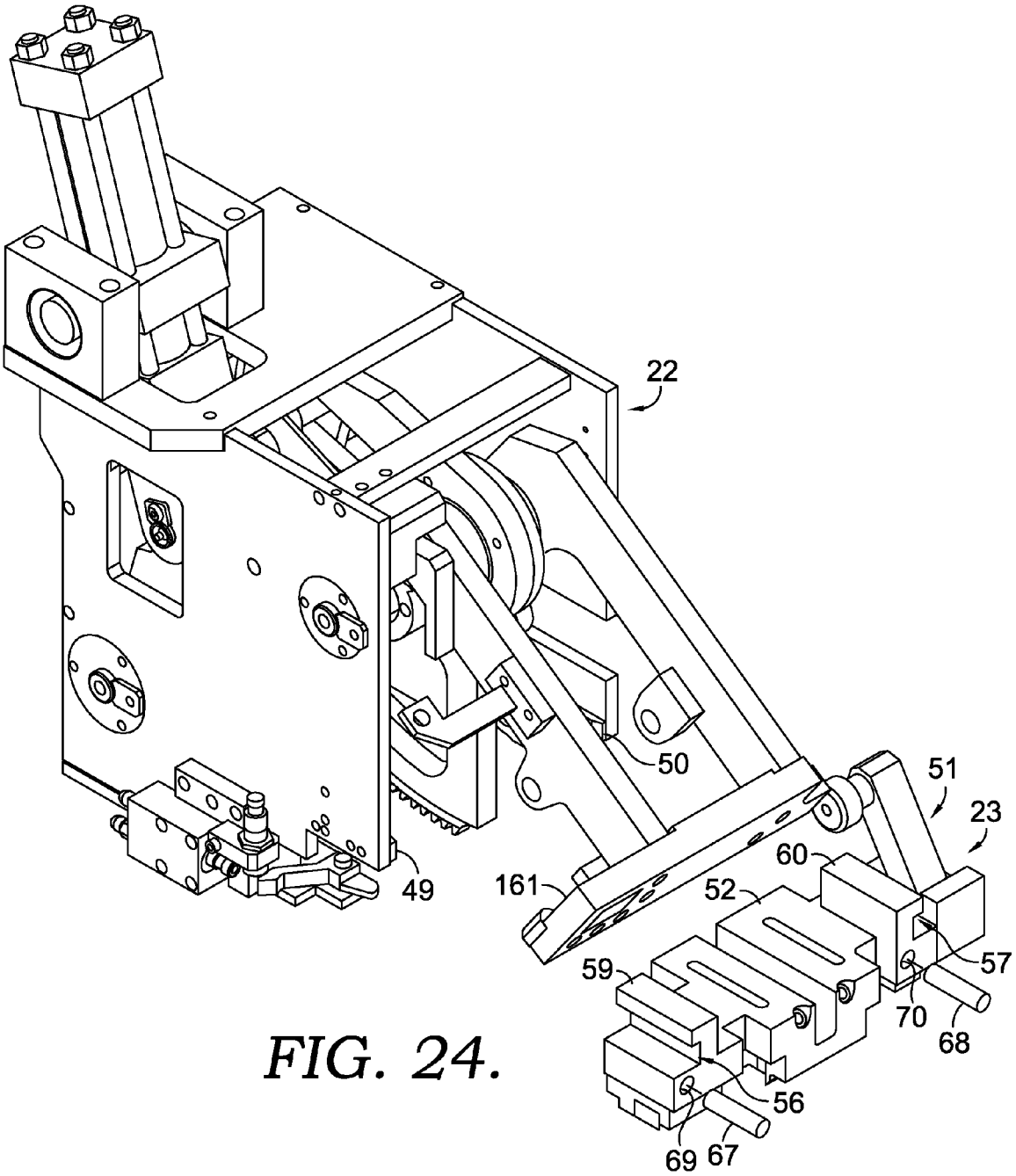
FIG. 24 depicts a perspective view of a frame assembly and a twist module assembly adjacent thereto and ready for coupling therewith for use in a modular knotter assembly in accordance with embodiments of the invention.

With reference to FIG. 24, the twist module assembly 23 is configured to be removably coupled with the frame assembly 22. The twist module assembly 23 includes a modular housing 52 that is slidably removable from the frame assembly 22. A cutter assembly 51 is attached at a first end of the modular housing 52 (i.e., the cutting side).

The modular housing 52 is coupled to the frame assembly 22 by sliding the modular housing 52 onto the frame assembly 22. This slidable coupling is achieved by aligning each of the mounting channels 56, 57 with a corresponding guide rail 49, 50 and sliding the module-mounting members 59, 60 onto the respective guide rails 49, 50 such that the guide rails 49, 50 occupy the channels 56, 57. The modular housing 52 is temporarily secured into place with two connectors 67, 68 such as, for example, bolts or other coupling devices, that are inserted into bores 69, 70, respectively, and pass into threaded bores 71, 72 of mounting blocks 47, 48 (illustrated in FIG. 22). In this manner, the modular housing 52 (and thus, the twist module assembly 23) can be easily removed and replaced by removing the two connectors 67, 68 and sliding the modular housing 52 off of the guide rails 49, 50.

As illustrated in FIG. 24, a user can lift the knotter cover 161 to a first or second open position. The operation described above of the ratchet assembly 26 locks the cover 161 in the selected position. In this manner, the user can service parts of the knotter assembly 17 such as, for example, by removing the twist module assembly 23 from the frame assembly 22 and replacing it with another twist module assembly 23 having new or repaired parts or parts designed for tieing wire of a different gage.

Figure 25:
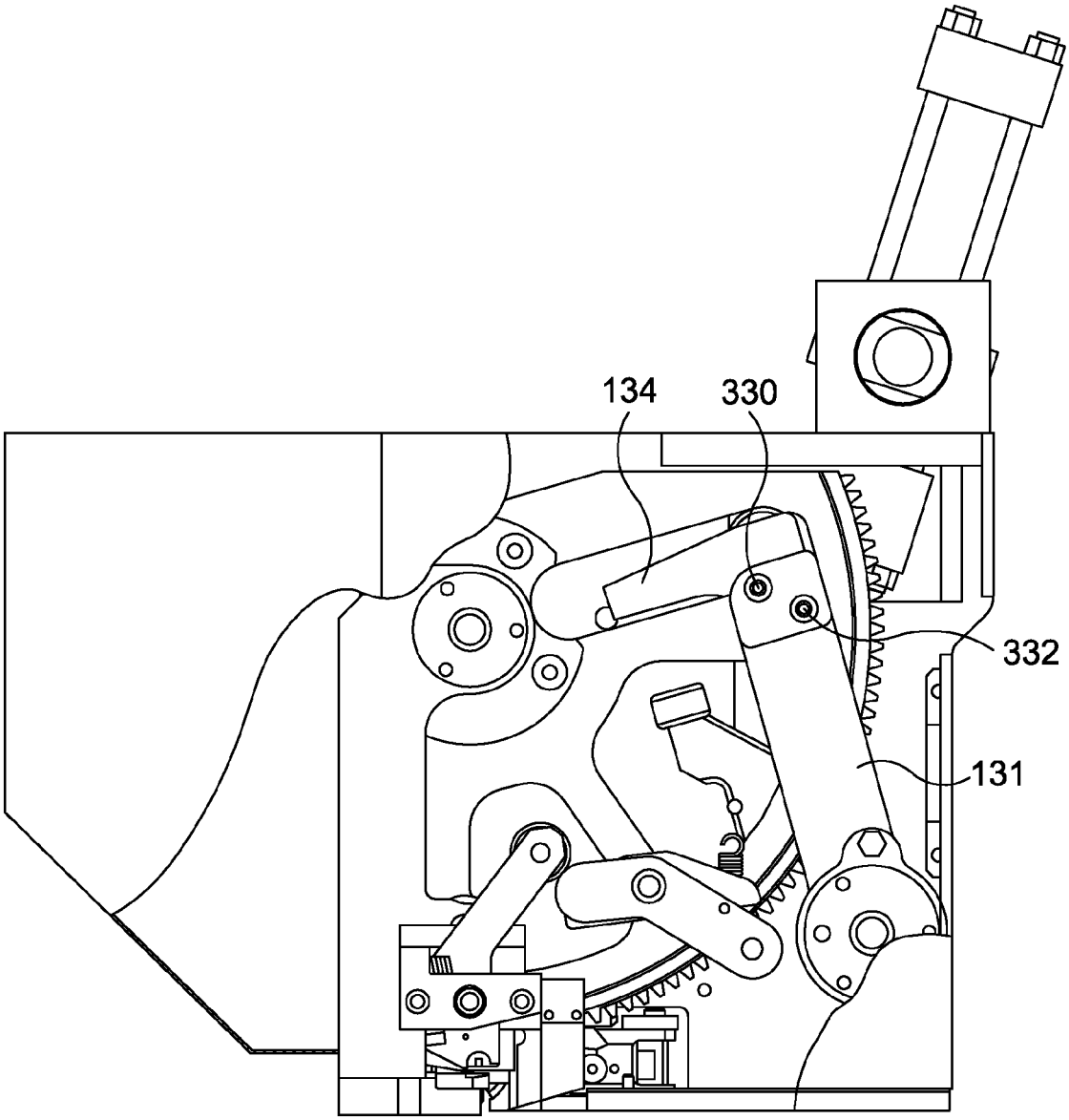
FIG. 25 depicts a right side elevation view, with portions of the side wall cutaway for clarity, of a modular knotter assembly in accordance with embodiments of the invention.
Figure 26:
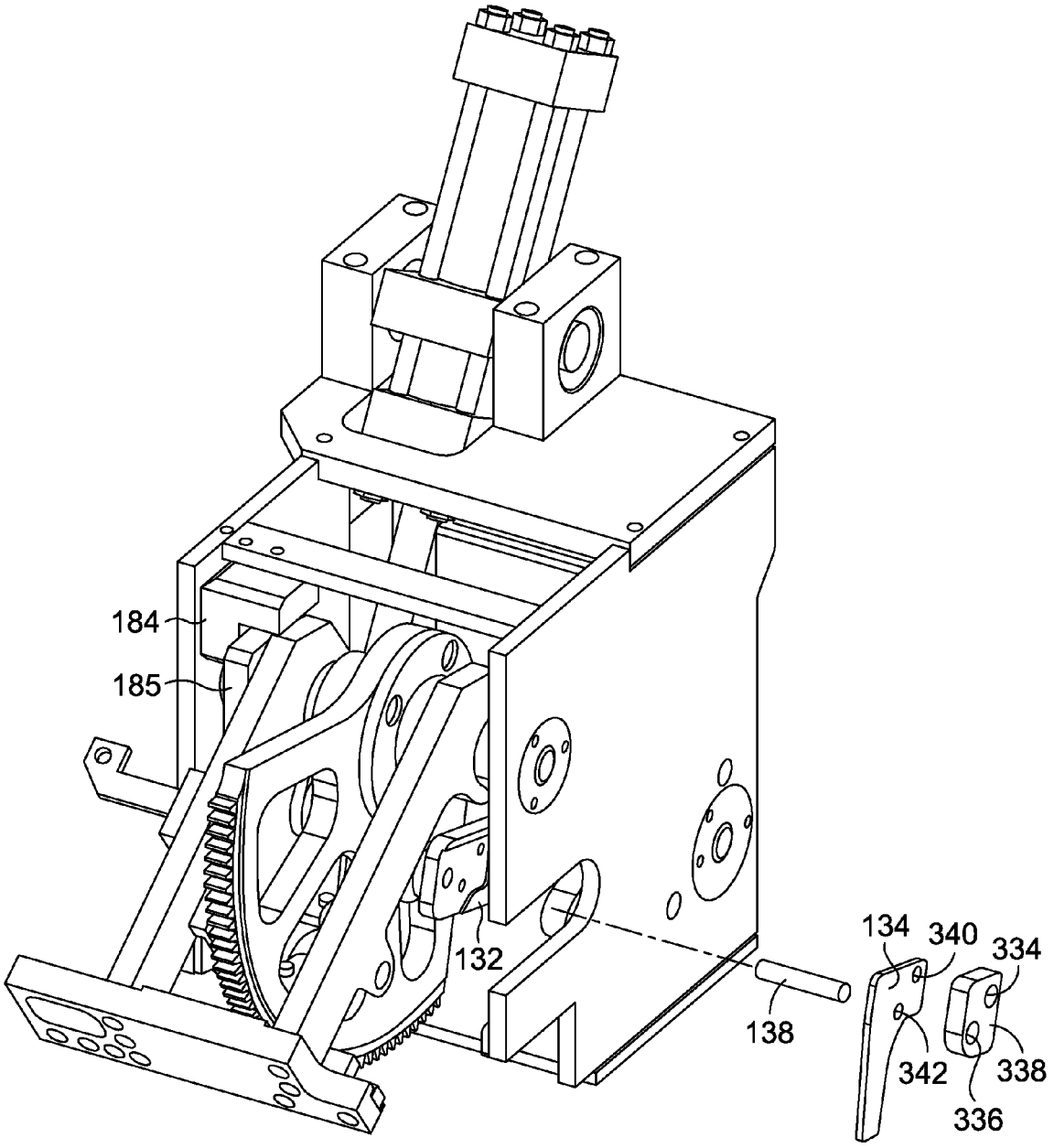
FIG. 26 depicts a partially exploded perspective view of a modular knotter assembly with a camroll shaft and an ejector finger removed, according to embodiments of the invention.

Turning now to FIGS. 25 and 26, the roller cam 137 and the camroll shaft 138 can be also be removed for servicing. The roller cam 137 is rotatably disposed between the second ends of the operating arms 131, 132. The camroll shaft 138 extends through the roller cam 137 and the operating arms 131, 132 abutting the wire ejector fingers 134, 135. To remove the roller cam 137 or the camroll shaft 138, the user removes a wire ejector finger, such as wire ejector finger 134, from the torque tube assembly. Wire ejector finger 134 is temporarily secured into place with two connectors 330, 332 such as, for example, bolts or other coupling devices, that are inserted into bores 334, 336 of cover plate 338 and pass into bores 340, 342 of wire ejector finger 134, respectively. Upon removing at least one wire ejector finger, camroll shaft 138 that couples the torque tube assembly 28 to the segment gear 140 can be removed as well as the roller cam 137.

Figure 27:
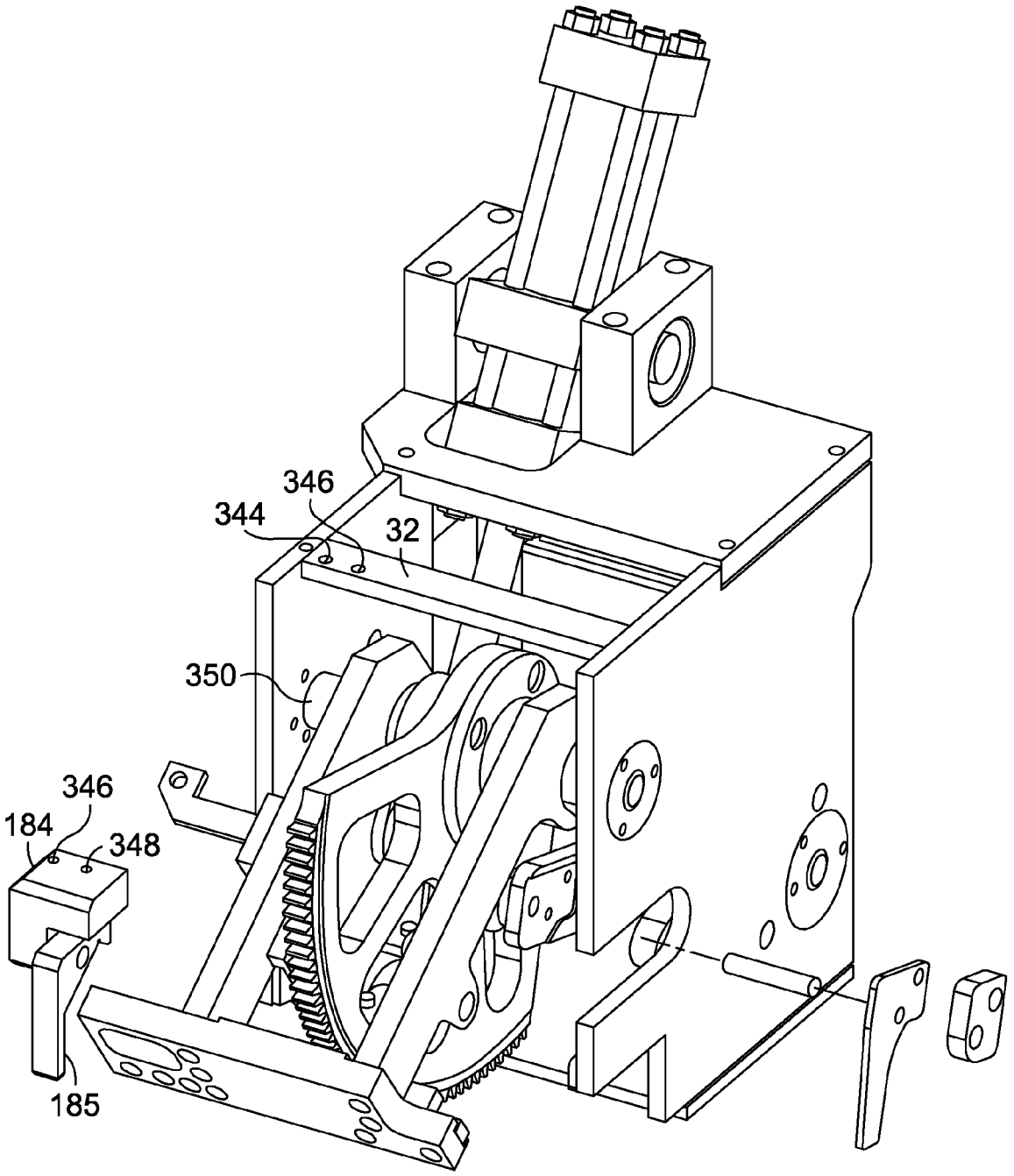
FIG. 27 depicts the modular knotter assembly of FIG. 26, with at least a portion of a ratchet assembly removed, in accordance with embodiments of the invention.

At least a portion of the ratchet assembly 26 can also be removed. For example, as is best seen in FIGS. 26-27, the ratchet latch mounting block 184 and the ratchet gear lever 185 can be removed by removing connectors (not shown) that are inserted into bores 344, 346 of top brace 32 and through bores 346, 348 of the ratchet latch mounting block 184.

Figure 28:
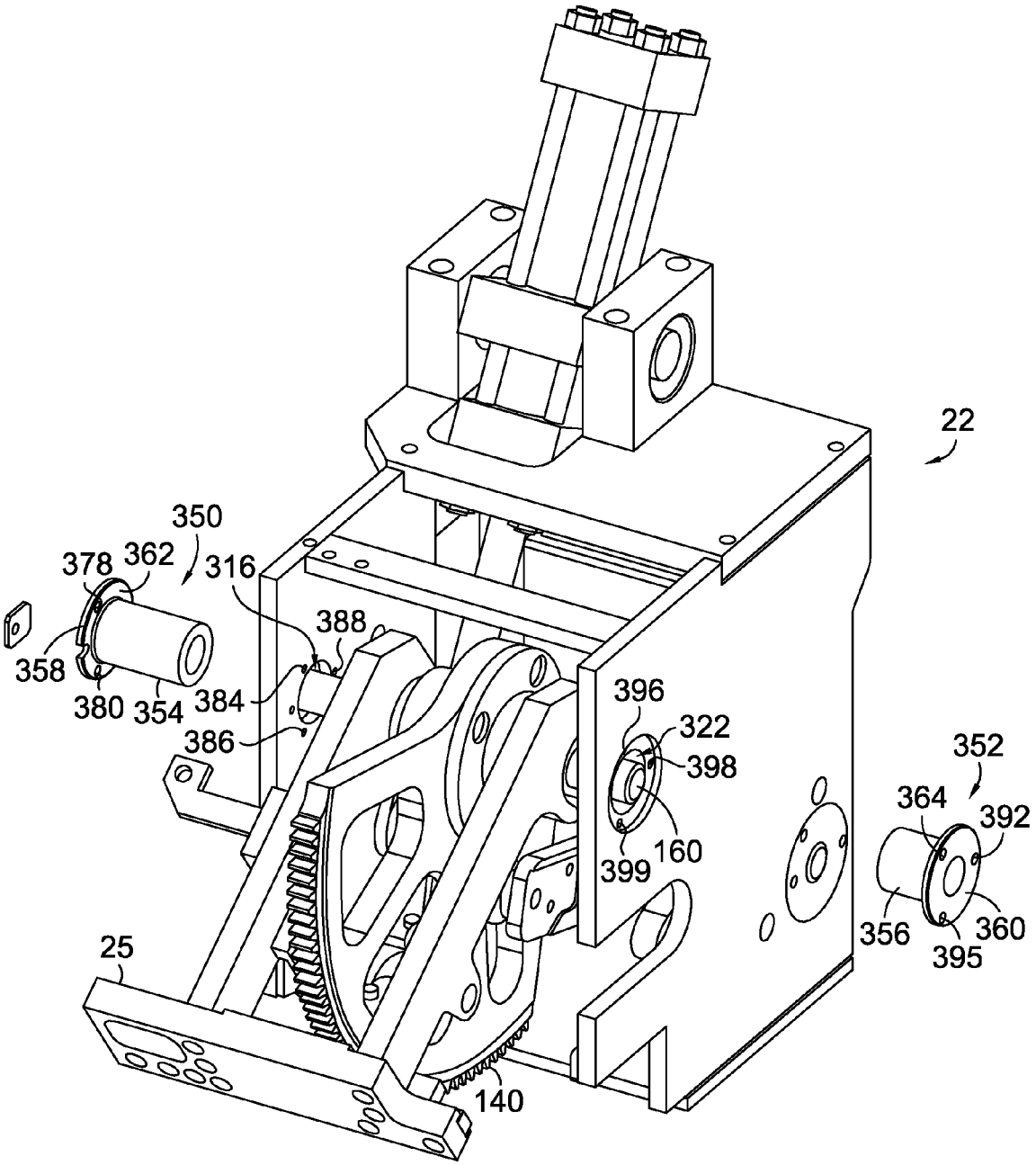
FIG. 28 depicts a partially exploded perspective view of a modular knotter assembly with left flange and right flanges removed, according to embodiments of the invention.
Figure 29:
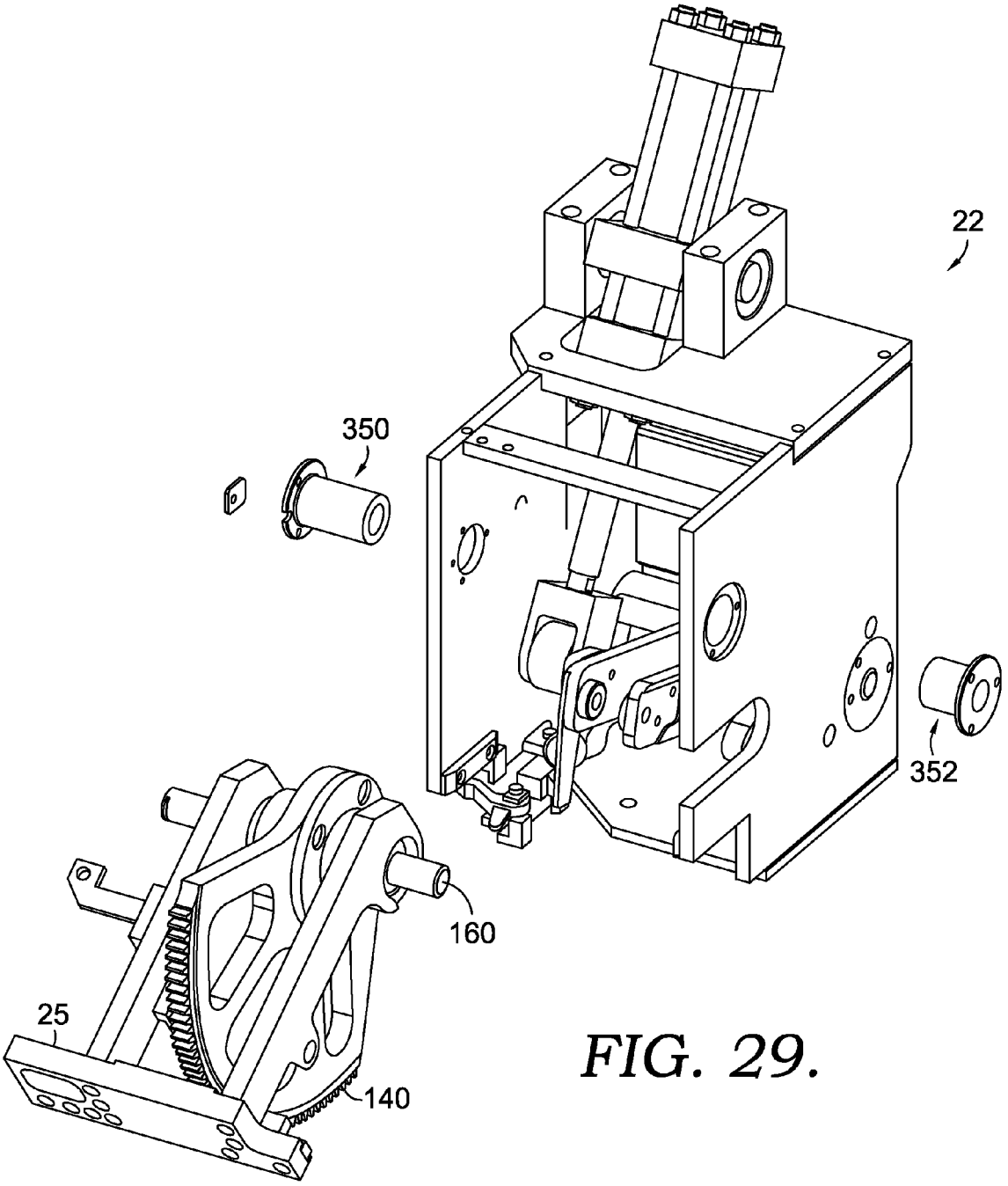
FIG. 29 depicts the modular knotter assembly of FIG. 28, with a traverse support shaft, segment gear, and knotter arm assembly removed in accordance with embodiments of the invention.

As illustrated in FIGS. 28 and 29, the segment gear 140, traverse support shaft 160, and the knotter arm assembly 25 are also removably coupled to the frame assembly 22. Accordingly, such components can be easily assembled and disassembled as a unit for servicing and/or replacement. The segment gear 140, traverse support shaft 160, and the knotter arm assembly 25 can be removed by removing flanges 350 and 352. Flange 350 passes through or is inserted through aperture 316 of the frame assembly 22. Flange 350 includes a cylindrical protrusion 354 that extends from a ring portion 358. Similarly, flange 352 passes through or is inserted through aperture 322 of the frame assembly 22. Flange 352 includes a cylindrical protrusion 356 that extends from a ring portion 360. As illustrated in FIG. 28, the cylindrical protrusion 354 of flange 350 is longer than the cylindrical protrusion 356 of flange 352 such that flange 350 extends further from the frame assembly 22 to accommodate positioning of segment gear 140 and knotter arm assembly 25. The lengths of flanges 350, 352, however, can be any length that functions to couple the segment gear 140, traverse support shaft 160, and knotter arm assembly 25 to the frame assembly 22.

The traverse support shaft 160 is coupled to the frame assembly 22 by sliding the flanges 350, 352 through their respective aperture 316, 322. This slidable coupling is achieved by aligning each of the outer portions of the cylindrical protrusions 354, 356 with their corresponding aperture 316, 322 and sliding the flanges 350, 352 through the apertures 316, 322 onto the traverse support shaft 160 such that the cylindrical protrusions 354, 356 surround the first and second ends of the traverse support shaft 160. An interior face 362 of the ring portion 358 of flange 350 mates with recessed portion 324 of the frame assembly 22, and an interior face 364 of the ring portion 360 of flange 352 mates with recessed portion 322 of the frame assembly 22. Flange 350 is temporarily secured into place with three connectors (not shown) such as, for example, bolts or other coupling devices, that are inserted into bores 378, 380, 382 of flange 350 and pass into bores 384, 386, 388 of recessed portion 320 of the frame assembly 22. Similarly, flange 352 is temporarily secured into place with three connectors (not shown) such as, for example, bolts or other coupling devices, that are inserted into bores 390, 392, 394 of flange 352 and pass into bores 396, 398, 399 of recessed portion 322 of frame assembly 22.

Accordingly, to remove the segment gear 140, traverse support shaft 160, and knotter arm assembly 25 unit, a user can remove flanges 350, 352. Flange 350 can be removed by removing the connectors 366, 368, 370 that pass through the ring portion 358 of flange 350 and the corresponding recessed portion 320 of the frame assembly 22. Flange 352 can be removed by removing the connectors 372, 374, 376 that pass through the ring portion 360 of flange 352 and the corresponding recessed portion 322 of the frame assembly 22. Upon removing the flanges 350, 352, the traverse support shaft 160 coupled to the segment gear 140 and the knotter arm assembly 25 can be canted and then removed from the frame assembly 22, as illustrated in FIG. 29.

Figure 30:
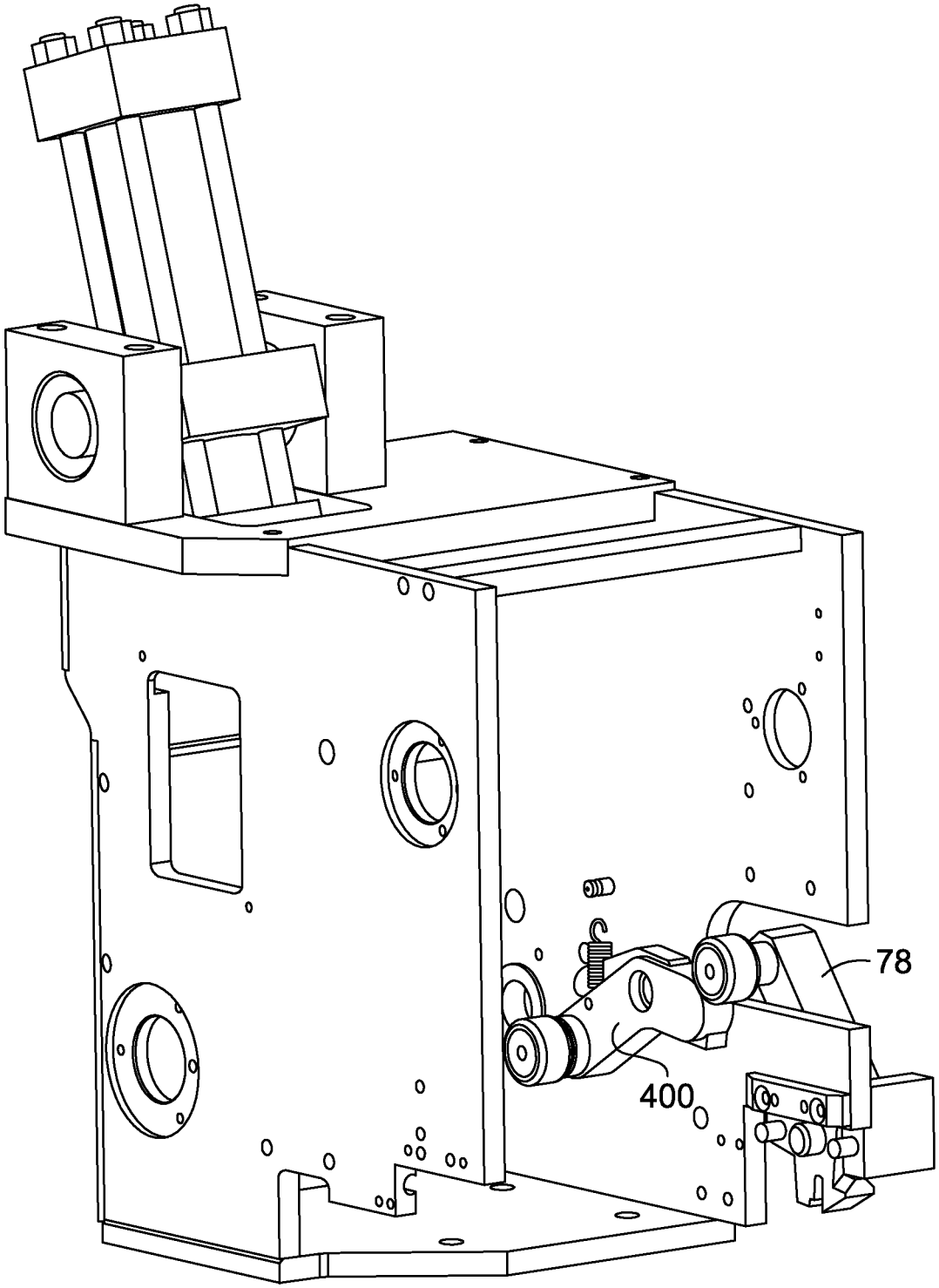
FIG. 30 depicts a perspective view of a modular knotter assembly with components omitted to better illustrate an actuating lever removably attached to the frame assembly, in accordance with embodiments of the invention.
Figure 31:
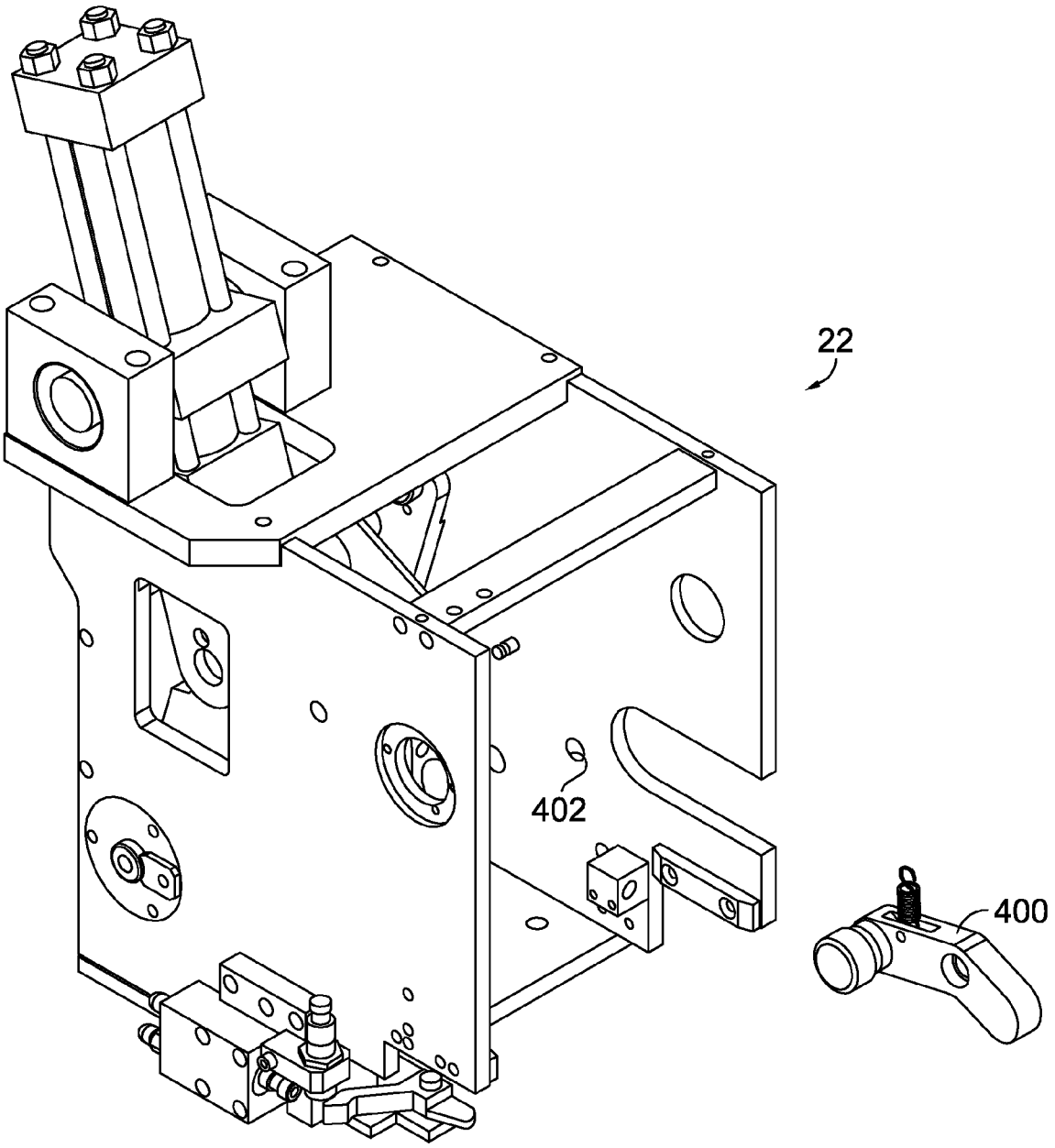
FIG. 31 depicts the modular knotter assembly of FIG. 30 with the actuating lever removed, according to embodiments of the invention.

Turning now to FIGS. 30 and 31, an actuating lever 400 is removably coupled to the frame assembly 22. The actuating lever 400 actuates the cutting lever 78 that cuts wire. When the torque tube assembly 28 rotates downward, the actuating lever 400 pivots up and actuates the cutting lever 78. The actuating lever 400 can be removed by removing a connector (not shown) that passes through a bore 402 of the frame assembly 22.

Figure 32:
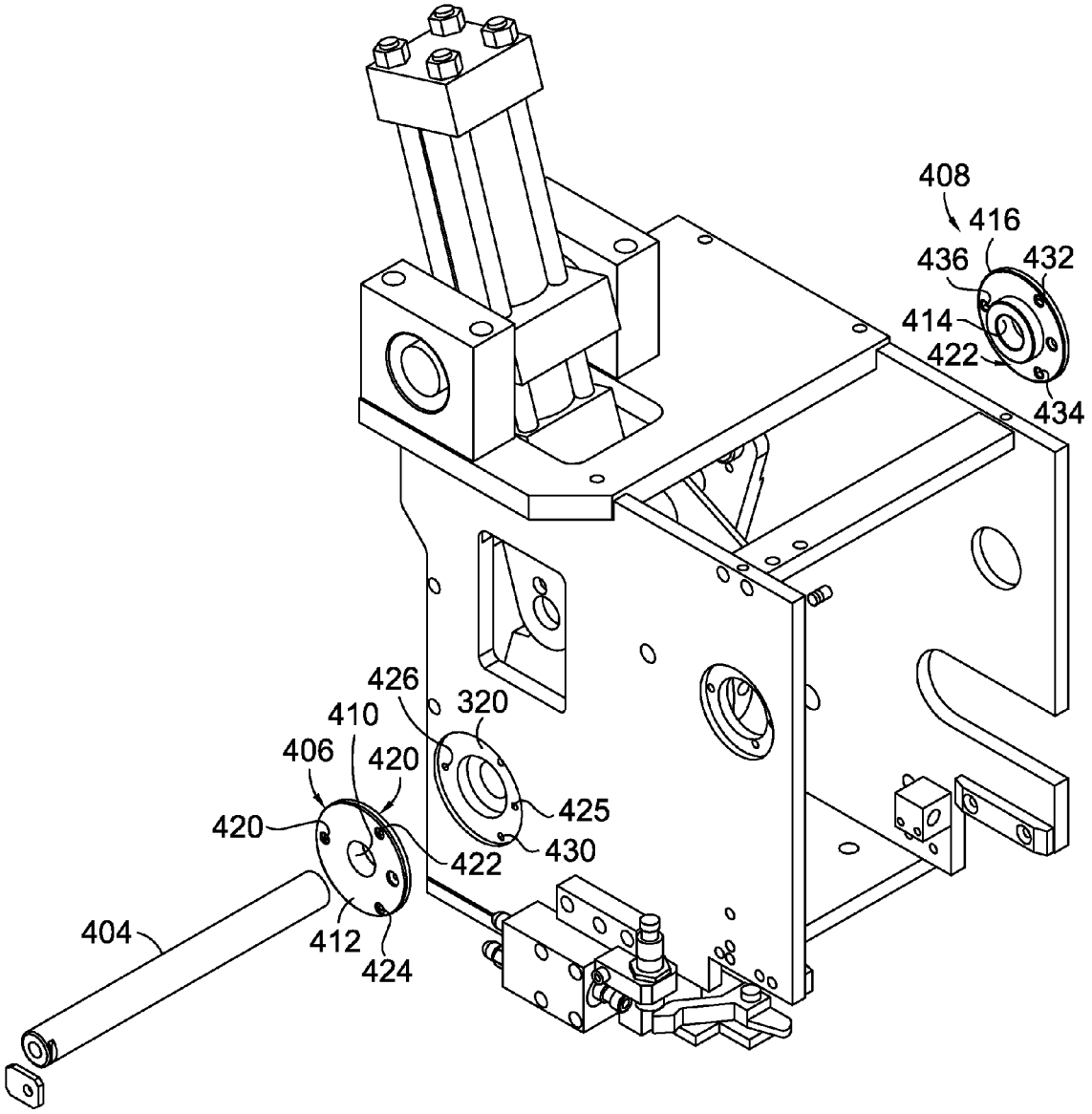
FIG. 32 depicts a partially exploded perspective view of a modular knotter assembly with components omitted to better illustrate a left flange, a right flange, and a pivot shaft removed in accordance with embodiments of the invention.
Figure 33:
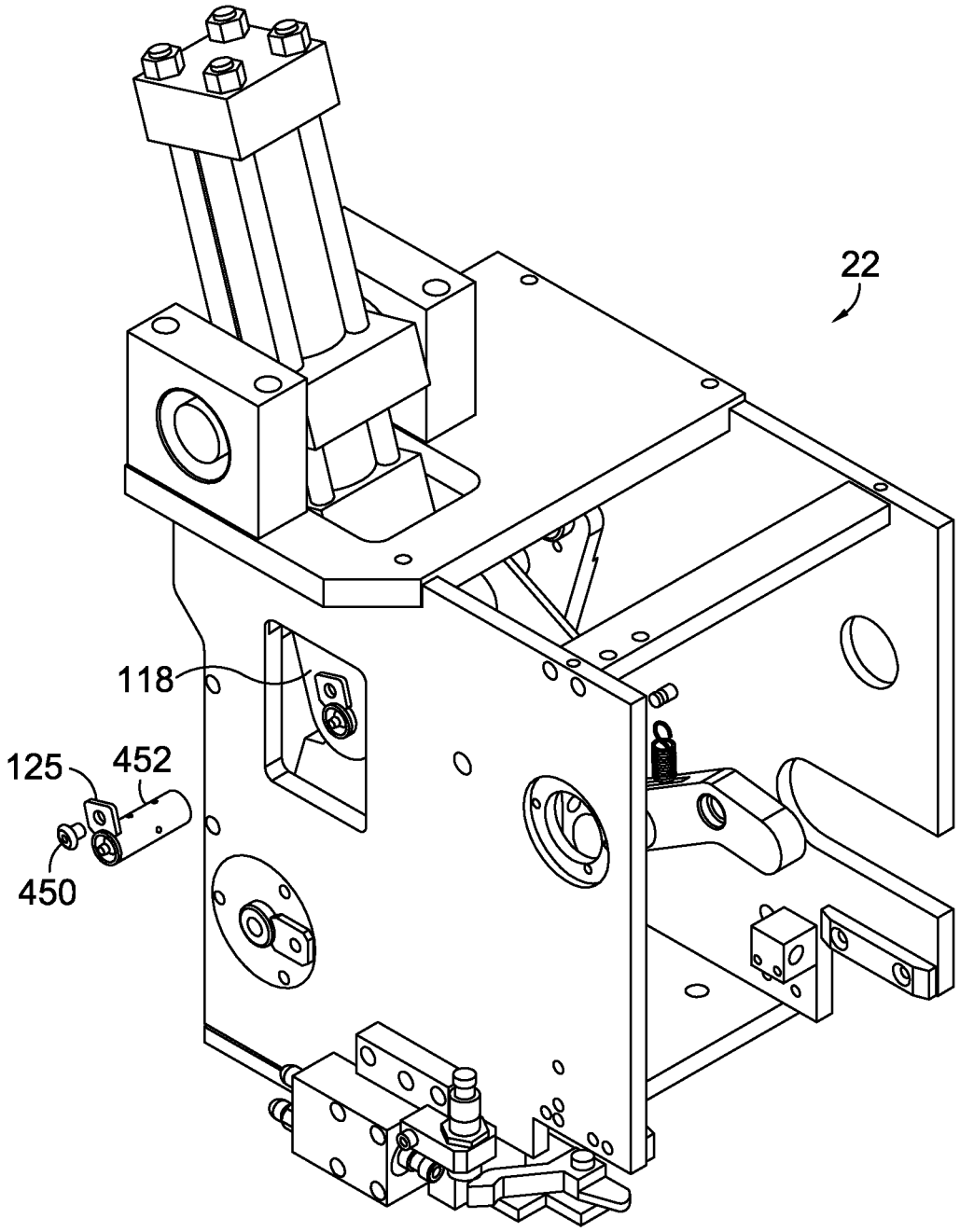
FIG. 33 depicts a partially exploded perspective view of a modular knotter assembly with components omitted to better illustrate a pin removed, according to embodiments of the invention.
Figure 34:
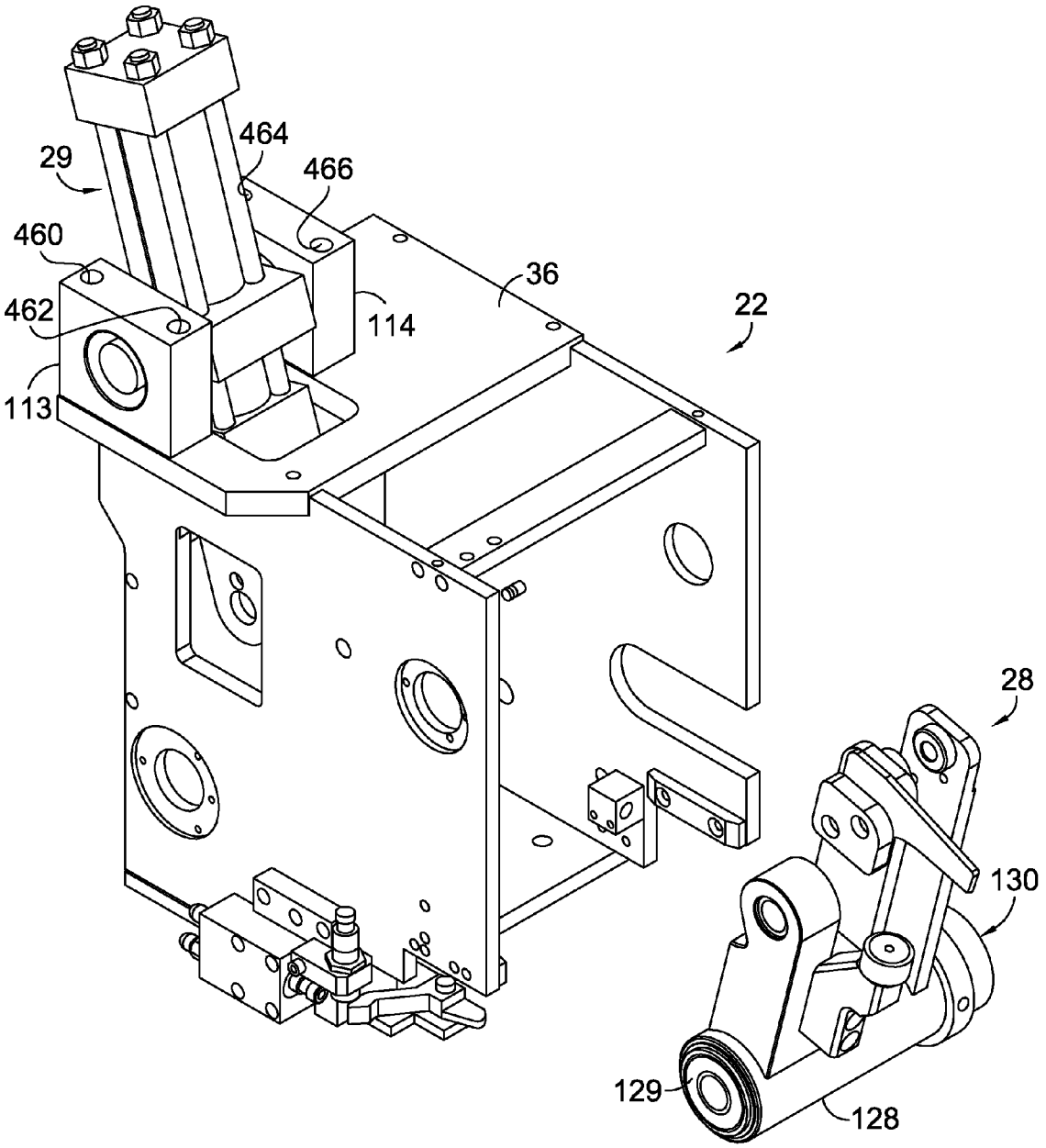
FIG. 34 depicts a partially exploded perspective view of a modular knotter assembly with components omitted to better illustrate a torque tube assembly removed in accordance with embodiments of the invention.

As is best seen in FIGS. 32-34, the torque tube assembly 28 (FIG. 34) is removably coupled to the frame assembly 22. The torque tube assembly 28 includes a torque tube 128 rotatably mounted within the frame assembly 22. A pivot shaft 404 extends through the torque tube 128, the torque tube bearings 129, 130, each of which extends into the respective end of the torque tube 128, and flanges 406, 408, which function like flanges 350 and 352 discussed above. In that regard, flange 406 passes through or is inserted through aperture 312 of frame assembly 22 and couples with the torque tube bearing 129. Flange 406 includes a cylindrical protrusion 410 that extends from a ring portion 412. Similarly, flange 408 passes through or is inserted through aperture 310 of the frame assembly 22 and couples with torque tube bearing 130. Flange 408 includes a cylindrical protrusion 414 that extends from a ring portion 416. The pivot shaft 404 supports the torque tube 128 such that the torque tube 128 can rotate about an axis oriented lengthwise through the center of the torque tube 128.

The torque tube 128 and torque tube bearings 129, 130 are slid onto the pivot shaft 404. The torque tube assembly 28 is then coupled to the frame assembly 22 by sliding the flanges 406, 408 through the respective aperture 312, 310. This slidable coupling is achieved by aligning each of the outer portions of the cylindrical protrusions 410, 414 with their corresponding aperture 312, 310 and sliding the flanges 406, 408 through the apertures 312, 310 onto the pivot shaft 404 such that the cylindrical protrusions 410, 414 surround a first end and a second end of the pivot shaft 404. An interior face 420 of the ring portion 412 of flange 406 mates with recessed portion 320 of frame assembly 22, and an interior face 422 of the ring portion 416 of flange 408 mates with recessed portion 318 of frame assembly 22. Flange 406 is temporarily secured into place with three connectors (not shown), such as, for example, bolts or other coupling devices, that are inserted into bores 420, 422, 424 of flange 406 and pass into bores 426, 428, 430 of recessed portion 320 of the frame assembly 22. Similarly, flange 408 is temporarily secured into place with three connectors (not shown), such as, for example, bolts or other coupling devices, that are inserted into bores 432, 434, 436 of flange 408 and pass into bores 438, 440, 442 (illustrated in FIG. 23) of recessed portion 318 of the frame assembly 22.

Accordingly, to remove the torque tube assembly 28, a user can remove the flanges 406, 408. Flange 406 can be removed by removing connectors that pass through the ring portion of the flange 406 and the corresponding recessed portion of the frame assembly 22. Flange 408 can be removed by removing connectors that pass through the ring portion of the flange 408 and the corresponding recessed portion of the frame assembly 22. In addition to removing the flanges 406, 408, and with reference to FIG. 33, connector 450 is removed from the clevis pin tab 125 coupled with pin 452 such that pin 452 can be slidably removed from the torque tube assembly 28 and the cylinder assembly 29. The clevis pin tab 125 is secured to an outside surface of the clevis 118 for holding the pin 452 in place. Upon removing the flanges 406, 406 and pin 452, the torque tube assembly 28 can be removed from the frame assembly 22, as illustrated in FIG. 34.

With continued reference to FIG. 34, the cylinder assembly 29 is removably secured to the frame assembly 22. The cylinder assembly 29 is temporarily secured into place with four connectors (not shown) such as, for example, bolts or other coupling devices, that are inserted into bores 460, 462 of cylinder mount block 113 and bores 464, 466 of cylinder mount block 114. The connectors pass through the corresponding cylinder mount block 113, 114 and through the cylinder mount 36 of the frame assembly 22. Upon removing the connectors, the cylinder assembly 29 can be removed from the frame assembly 22.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

What is claimed is:

1. A knotter assembly for use in a wire-tieing system on a baler, the assembly comprising:

a base plate;

a first side wall and a second side wall that are substantially parallel to one another, wherein the first side wall and the second side wall each includes a respective interior surface facing towards one another and wherein the first side wall includes a first inward protruding member that protrudes towards the respective interior surface of the second wall and the second side wall includes a second inward protruding member that protrudes toward the respective interior surface of the first side wall; and a twist module positionable between the respective interior surfaces, wherein the twist module includes a first module-mounting member for attachment to the first inward protruding member and a second module-mounting member for attachment to the second inward protruding member, wherein the first module-mounting member includes a first channel having surfaces that slidably mate around the first inward protruding member when the twist module is inserted between the respective interior surfaces, and wherein the second module-mounting member includes a second channel having surfaces that slidably mate around the second inward protruding member when the twist module is inserted between the respective interior surfaces.

2. The assembly of claim 1, wherein the first and second side walls include a respective exterior surface and wherein each of the respective exterior surfaces includes a recessed portion that surrounds a corresponding aperture for receiving a pivot shaft.

3. The assembly of claim 2 further comprising, a set of flanges for selectively securing the pivot shaft, which includes a first end and a second end, is disposed between the side walls, and rotatably supports a torque-tube assembly disposed between the flanges when installed, wherein each flange attaches to one of the respective exterior surfaces, wherein each of the flanges includes a cylindrical protrusion that extends from a ring portion of the flange, each of the flanges being slidably coupled with the pivot shaft by aligning an outer portion of the cylindrical protrusion with a corresponding aperture and sliding the flanges through the corresponding aperture onto the pivot shaft such that the cylindrical protrusions surround the first and second ends of the pivot shaft, and wherein an interior face of the ring portions of the flanges mates with the corresponding recessed portion when installed.

4. The assembly of claim 3, wherein one or more connectors are utilized to selectively secure flanges to the respective exterior surface of the corresponding side wall when installed.

5. The assembly of claim 1 further comprising, a torque tube assembly that rotates one or more operating arms for ejecting wire from the knotter assembly and that is removably coupled between the pair of side walls, wherein a removable fastener couples the torque tube assembly to a cylinder assembly, wherein the torque tube assembly comprises a gripper-release assembly, and wherein the removable fastener includes a pin that slidably inserts through clevis holes positioned at an end of the cylinder assembly and through a hole in the gripper-release assembly.

6. The assembly of claim 5, wherein the pin includes a clevis pin and wherein the removable fastener includes a clevis tab that engages the clevis pin and that is secured to an outside surface of a clevis of the cylinder assembly with a removable connector.

7. The assembly of claim 1, wherein the first channel and the second channel each includes a top surface and another surface that opposes the top surface to form an elongated void therebetween.

8. The assembly of claim 7, wherein the inward protruding members include guide rails that slidably fit in the elongated voids.

9. A wire-tieing machine for twisting or tieing together end portions of wires comprising:

a frame assembly, wherein the frame assembly includes a base plate and a pair of parallel opposed side walls, and further wherein a first side wall has a first aperture formed therein for removably coupling a pivot shaft and a second aperture formed therein for removably coupling a traverse support shaft and wherein a second side wall has a third aperture formed therein for removably coupling the pivot shaft and a fourth aperture formed therein for removably coupling the traverse support shaft;

a torque tube assembly that rotates about the pivot shaft to operate one or more operating arms for ejecting wire from the wire-tieing machine and that is removably coupled between the pair of parallel opposed side walls, wherein a pin removably fastens the torque tube assembly to a cylinder assembly, the pin including a clevis pin tab that radially extends away from an axis of the pin and that includes a hole, and wherein a removable fastener is removably secured through the hole and through an outside surface of a clevis of the cylinder assembly;

a first pair of flanges each having a first cylindrical protrusion extending from a first ring portion, the first pair of flanges removably coupled to respective outside surfaces of the first wall and the second wall, the respective outside surfaces facing away from one another, and removably coupled to the pivot shaft by way of the first aperture and the third aperture, the pivot shaft having a first end and a second end disposed between the first side wall and the second side wall, that supports the torque tube assembly disposed between the first pair of flanges, wherein the torque tube assembly includes a torque tube and a pair of operator members attached to the torque tube; and a second pair of flanges each having a second cylindrical protrusion extending from a second ring portion, the second pair of flanges removably coupled to the traverse support shaft by way of the second aperture and the fourth aperture, wherein the traverse support shaft, having a third end and a fourth end disposed between the first side wall and the second side wall, rotatably supports a segment gear.

10. The machine of claim 9, wherein a first mounting block and a first twist-module guide rail is attached to an inside surface of the first side wall, and further wherein a second mounting block and a second twist-module guide rail is attached to an inside surface of the second side wall.

11. The machine of claim 10 further comprising a twist module assembly, wherein the twist module assembly includes a main block that houses a twister pinion having a pinion gear, and wherein the twist module assembly is removably coupled to the frame assembly by way of a pair of slots that fit over the respective twist module guide rails.

12. The machine of claim 11, wherein a segment gear engages with the twister pinion to cause rotation of the twister pinion.

13. The machine of claim 12, wherein a roller cam engages a straight slot defined within the segment gear to actuate rotation of the segment gear.

14. The machine of claim 9 further comprising a knotter cover arm assembly, wherein the knotter cover arm assembly includes a pair of opposed knotter cover arms coupled, at a lower end of each arm, to a knotter cover, and pivotably coupled, at an upper end of each arm, to the traverse support shaft such that rotation of the arms causes the knotter cover to lift away from the wire-tieing machine.

15. The machine of claim 9, wherein the cylinder assembly is removably coupled to the frame assembly by way of one or more connectors, the cylinder assembly including a drive assembly and a hydraulic cylinder, which is removably coupled to the torque tube assembly.

16. A wire-tieing machine for twisting or tieing together end portions of wires comprising:

a frame assembly, wherein the frame assembly includes a base plate and a pair of parallel opposed side walls;

a twist module assembly removably coupled with the frame assembly, wherein the twist module assembly includes a main block that houses a twister pinion having a pinion gear with a first plurality of teeth; and a segment gear assembly, wherein the segment gear assembly includes a segment gear having a second plurality of teeth that engage the first plurality of teeth of the pinion gear when rotated to generate a four-twist knot, wherein the segment gear includes a straight drive slot that is straight from a first terminating end of the slot to a second terminating end of the slot.

17. The machine of claim 16, wherein the straight drive slot extends radially outwardly from an aperture formed within the segment gear, the aperture being positioned at a center axis of rotation of the segment gear.

18. The machine of claim 16, wherein the first plurality of teeth of the pinion gear comprises 12 teeth and the second plurality of teeth of the segment gear comprises 48 teeth.

19. The machine of claim 16 wherein a roller cam engages the straight slot defined within the segment gear to actuate rotation of the segment gear.

20. The machine of claim 16 wherein the roller cam translates down the straight drive slot to generate rotation of the segment gear when a torque tube assembly pivots forward.

* * * * *